US011435050B2

(12) United States Patent
Kay

(10) Patent No.: US 11,435,050 B2
(45) Date of Patent: Sep. 6, 2022

(54) BI-FUNCTIONAL OPTICAL SYSTEMS AND METHODS

(71) Applicant: J.W. SPEAKER CORPORATION, Germantown, WI (US)

(72) Inventor: Bradley William Kay, Mequon, WI (US)

(73) Assignee: J.W. SPEAKER CORPORATION, Germantown, WI (US)

( * ) Notice: Subject to any disclaimer, the term of this patent is extended or adjusted under 35 U.S.C. 154(b) by 0 days.

(21) Appl. No.: 17/378,527

(22) Filed: Jul. 16, 2021

(65) Prior Publication Data

US 2022/0018512 A1 Jan. 20, 2022

Related U.S. Application Data

(60) Provisional application No. 63/053,130, filed on Jul. 17, 2020.

(51) Int. Cl.

| | |
|---|---|
| ***F21S 41/40*** | (2018.01) |
| ***F21S 41/25*** | (2018.01) |
| ***F21S 41/143*** | (2018.01) |
| ***F21S 41/148*** | (2018.01) |
| ***F21S 41/32*** | (2018.01) |
| *F21W 102/13* | (2018.01) |

(52) U.S. Cl.

CPC ..... *F21S 41/40* (2018.01); *F21S 41/143* (2018.01); *F21S 41/148* (2018.01); *F21S 41/25* (2018.01); *F21S 41/32* (2018.01); *F21W 2102/13* (2018.01)

(58) Field of Classification Search

None

See application file for complete search history.

(56) References Cited

U.S. PATENT DOCUMENTS

| | | | |
|---|---|---|---|
| 6,776,513 | B2 | 8/2004 | Albou |
| 8,651,716 | B2 | 2/2014 | Albou et al. |
| 9,506,615 | B2 | 11/2016 | Brendle |
| 10,239,443 | B2 | 3/2019 | Kanayama et al. |
| 10,641,451 | B2 | 5/2020 | Kawai et al. |

(Continued)

FOREIGN PATENT DOCUMENTS

| | | | |
|---|---|---|---|
| EP | 2405187 A1 * | 1/2012 | ..... F21S 41/147 |
| EP | 2523022 A1 | 11/2012 | |

(Continued)

OTHER PUBLICATIONS

PCT International Search Report and Written Opinion, PCT/US2021/042188, dated Oct. 25, 2021, 16 pages.

*Primary Examiner* — Elmito Breval

(74) *Attorney, Agent, or Firm* — Quarles & Brady LLP

(57) ABSTRACT

A lamp for a vehicle is provided that can include a housing, an axial symmetric lens coupled to the housing and defining an optical axis and a focal point, an image shifting lens positioned within the housing behind the axial symmetric lens relative to the optical axis, and a light source positioned within the housing. The light source can be positioned behind the image shifting lens. The light source can be configured to emit light along an optical path that extends, from the light source, through the image shifting lens, towards the axial symmetric lens above the optical axis, and through the axial symmetric lens to define a high beam illumination pattern.

19 Claims, 12 Drawing Sheets

(56) References Cited

U.S. PATENT DOCUMENTS

| | | | | |
|---|---|---|---|---|
| 2008/0112180 | A1* | 5/2008 | Okada | F21S 41/675<br>362/518 |
| 2008/0285297 | A1 | 11/2008 | Ishida | |
| 2012/0262935 | A1* | 10/2012 | Yamamoto | F21S 41/148<br>362/516 |
| 2015/0241030 | A1 | 8/2015 | Kanayama et al. | |

FOREIGN PATENT DOCUMENTS

| | | | |
|---|---|---|---|
| FR | 3065785 | A1 | 11/2018 |
| JP | 2007287522 | A | 11/2007 |
| JP | 2016039154 | A | 3/2016 |

* cited by examiner

BI-FUNCTIONAL OPTICAL SYSTEMS AND METHODS

CROSS-REFERENCE TO RELATED APPLICATIONS

This application claims priority to U.S. patent application Ser. No. 63/053,130 filed Jul. 17, 2020, and entitled, "Bi-functional Optical Systems and Methods," which is hereby incorporated by reference in its entirety.

STATEMENT REGARDING FEDERALLY SPONSORED RESEARCH

Not applicable.

BACKGROUND

Headlamps are generally configured to illuminate the road in front of a vehicle. Some headlamps produce a low beam pattern of light in front of the vehicle with forward and lateral illumination components, and a high beam pattern of light that provides a relatively bright and centrally located illumination pattern in front of the vehicle.

SUMMARY OF THE DISCLOSURE

The present disclosure provides bi-functional optical systems and methods. As will be described, systems and methods are provided that allow a single lamp (for a vehicle) to selectively produce a low beam illumination pattern alone, a high beam illumination pattern alone, or simultaneously a low beam illumination pattern and a high beam illumination pattern. Additionally, the single lamp construction is more compact (and less bulky) than some other designs.

Some aspects of the disclosure provide a lamp for a vehicle. The lamp can include a housing, an axial symmetric lens coupled to the housing and defining an optical axis and a focal point, and a first light source positioned within the housing. The first light source can be positioned behind the focal point of the axial symmetric lens relative to the optical axis. The lamp can include a second light source positioned within the housing. The second light source can be positioned in front of the focal point of the axial symmetric lens relative to the optical axis. The first light source can be configured to emit first light along a first optical path that can extend from the first light source, towards the axial symmetric lens below the optical axis, and through the axial symmetric lens to define a low beam illumination pattern. The second light source can be configured to emit second light along a second optical path that can extend, from the second light source, towards the axial symmetric lens above the optical axis, and through the axial symmetric lens to define a high beam illumination pattern.

In some aspects, a lamp can include an image shifting lens positioned within a housing between a second light source and an axial symmetric lens, A second optical path can extend, from the second light source, through the image shifting lens, and through the axial symmetric lens.

In some aspects, at least a portion of an image shifting lens can be positioned above a focal point and above an optical axis of an axial symmetric lens. The image shifting lens can be configured to receive at a rear surface an image defining a first focal point, and to project a shifted image out of a front surface of the image shifting lens. The shifted image can define a second focal point that is shifted from the first focal point away from the axial symmetric lens relative to the optical axis.

In some aspects, a second focal point of a shifted image overlaps with a focal point of an axial symmetric lens.

In some aspects, a lamp can include a reflector positioned within a housing. A first optical path can extend from a first light source, towards the reflector, and towards an axial symmetric lens away from the reflector.

In some aspects, a lamp can include a physical shield positioned within a housing. A physical shield can block a portion of light emitted from a first light source from being transmitted through an axial symmetric lens.

In some aspects, a physical shield can be positioned below an upper reflective surface of a reflector. The physical shield can have an extension that extends out from an interior volume of the reflector towards an axial symmetric lens. The extension can define a peripheral edge that can include a first linear region, a second linear region; and a curved region between the first and second linear regions. The curved region can be concave.

In some aspects, a physical shield can be oriented substantially parallel to an optical axis of an axially symmetric lens. The physical shield can include a well. A first thickness of the physical shield at the well can be smaller than a second thickness of the physical shield.

In some aspects, a lamp can include a wall coupled to and positioned within a housing. The wall can extend towards an optical axis so that the wall is substantially perpendicular to the optical axis. The lamp can include a support that can be coupled to and positioned within the housing. The support can extend away from an axial symmetric lens relative to the optical axis. A portion of the support can be substantially parallel to the optical axis. A first light source can be coupled to a surface of the support that faces a reflector. A second light source can be coupled to a surface of the wall that faces the axial symmetric lens.

In some aspects, a lamp can include an optical ring having a hole directed therethrough. The optical ring can be positioned within a housing behind an axial symmetric lens. The lamp can include a plurality of light sources, different from the first and second light sources, each of which can be positioned behind the optical ring and in front of a first light source relative to an optical axis.

In some aspects, a plurality of light sources can be positioned radially away from a second light source relative to an optical axis so that the plurality of light sources surround a second light source.

In some aspects, each of a plurality of light sources can be configured to emit amber light. A first light source can be configured to emit white light. A second light source can be configured to emit white light.

In some aspects, an optical ring can be a first optical ring. A lamp can include a second optical ring having a hole directed therethrough. The second optical ring can be positioned within a housing in front of the first optical ring relative to an optical axis. An axial symmetric lens can be inserted through the hole of the second optical ring. The lamp can include a cover coupled to the housing. At least a portion of the cover can be positioned in front of the axial symmetric lens.

In some aspects, a portion of a physical shield overlaps with a focal point of an axial symmetric lens.

In some aspects, a first light source can be configured to emit light that is reflected by a reflector and transmitted through an axial symmetric projection lens. A portion of the reflected light can be blocked and prevented from being transmitted to the axial symmetric projection lens by a physical shield. The reflected light can define a low beam illumination pattern.

In some aspects, a second light source can be configured to emit light that defines an image through an image shifting lens. The image shifting lens can be configured to shift the image back to a focal point of an axial symmetric projection lens. The image when projected through the axial symmetric lens can define a high beam illumination pattern.

In some aspects, a portion of a high beam illumination pattern can be overlaid on a low beam illumination pattern so that the portion of the high beam illumination pattern overlaps with the low beam illumination pattern.

Some aspects of the disclosure provide a lamp for a vehicle. The lamp can include a housing, an axial symmetric lens coupled to the housing and defining an optical axis and a focal point, an image shifting lens positioned within the housing behind the axial symmetric lens relative to the optical axis, and a light source positioned within the housing. The light source can be positioned behind the image shifting lens. The light source can be configured to emit light along an optical path that extends, from the light source, through the image shifting lens, towards the axial symmetric lens above the optical axis, and through the axial symmetric lens to define a high beam illumination pattern. The light source can be configured to emit light that defines an image through the image shifting lens. The image shifting lens can be configured to shift the image back to the focal point of the axial symmetric projection lens. The image when projected through the axial symmetric lens can define a high beam illumination pattern.

In some aspects, a light source can be a first light source. An optical path can be a first optical path. A lamp can include a reflector positioned within a housing, and a second light source positioned within the housing. The second light source can be positioned behind a focal point of an axial symmetric lens relative to an optical axis. The lamp can include a physical shield that has a peripheral edge that can overlap with the focal point of the axial symmetric lens. The second light source can be configured to emit second light along a second optical path that extends from the second light source, towards the reflector, towards the axial symmetric lens away from the reflector, and through the axial symmetric lens to define a low beam illumination pattern.

In some aspects, a lamp can include a first plurality of light sources positioned within a housing in front of a second light source and surrounding a first light source. The plurality of light sources can emit light having a different color than light emitted from the first light source and the second light source.

In some aspects, a lamp can include a wall positioned within a housing between a reflector and an image shifting lens. A first light source can be coupled to the wall.

In some aspects, a focal point of an axial symmetric lens can be positioned between a first light source and a second light source.

Some aspects of the disclosure provide a lamp for a vehicle. The lamp can include a housing, an axial symmetric lens coupled to the housing and defining an optical axis and a focal point, and a first light source positioned within the housing behind the axial symmetric lens. The first light source can be configured to transmit light through the axial symmetric lens to define a low beam illumination pattern. The lamp can include a second light source positioned within the housing behind the axial symmetric lens and in front of the first light source. The second light source can be configured to transmit light through the axial symmetric lens to define a high beam illumination pattern. The lamp can include an optical ring having a hole directed therethrough. The optical ring can surround the first light source and the second light source. The optical ring can be positioned between the axial symmetric lens and the first light source. The lamp can include a plurality of light sources, different than the first and second light sources. The plurality of light sources can be positioned within the housing and surrounding the second light source.

In some aspects, a plurality of light sources can emit light having a different color than light emitted from a first light source and a second light source. The plurality of light sources can be configured to emit amber light. The first light source and the second light source can be configured to emit white light.

Some aspects of the disclosure provide a computer-implemented method of illuminating a scene away from a vehicle using a lamp that is coupled to the vehicle. The method can include causing, using one or more computing devices, the lamp to emit a low beam illumination pattern, and causing, using the one or more computing devices, the lamp to emit a low beam illumination pattern. Emitting the low beam illumination pattern does not include moving a physical shield that obstructs the projection of light from the lamp. Emitting the high beam illumination pattern does not include moving a physical shield that obstructs the projection of light from the lamp.

In some aspects, a method can include receiving, using one or more computing devices, a user input from a user input device of the vehicle, and adjusting, using the one or more computing devices, the light intensity of the one or more light sources of the lamp, based on the user input.

In some aspects, adjusting the light intensity of the one or more light sources includes one or more of stopping, using one or more computing devices, one or more light sources of the lamp from emitting light, causing, using the one or more computing devices, one or more light sources of the lamp to emit light, or changing, using the one or more computing devices, a light intensity of one or more light sources of the lamp.

In some aspects, a method can include causing, using one or more computing devices, the lamp to emit a parking illumination pattern, causing, using the one or more computing devices, the lamp to emit a directional indication illumination pattern, or causing, using the one or more computing devices, the lamp to emit a daytime illumination pattern.

In some aspects, a method can include causing, using one or more computing devices, the lamp to emit the directional indication illumination pattern while the lamp emits the low beam illumination pattern, the high beam illumination pattern, or both.

In some aspects, a lamp can include a first light source, a second light source different from the first light source, and a plurality of other light sources different from the first and second light sources that can surround the first light source and the second light source. A method can include causing, using one or more computing devices, one or more of the plurality of other light sources to emit light to generate a parking illumination pattern, a directional indication illumination pattern, or a daytime illumination pattern.

In some aspects, a method can include causing, using one or more computing devices, a first light source to emit light to generate a low beam illumination pattern, and causing, using the one or more computing devices, a second light source to emit light to generate a high beam illumination pattern.

In some aspects, a method can include receiving, using one or more computing devices, a sensor value from a sensor, and causing, using the one or more computing devices, a first light source and a second light source to generate a low beam illumination pattern, a high beam illumination pattern, or both based on the sensor value.

In some aspects, a sensor is a photosensor.

Some aspects of the disclosure provide a bi-functional lamp for a vehicle. The bi-functional lamp can include a housing having a first end and a second end, an axial symmetric lens coupled to the housing and defining an optical axis and a focal point, a reflector arranged within the housing and positioned adjacent to the second end of the housing, a physical shield arranged within the housing; and an image shifting lens arranged within the housing between the axial symmetric lens and the physical shield along the optical axis. The image shifting lens can be configured to shift an image emitted onto a rear surface of the image shifting lens back to substantially the focal point of the axial symmetric lens to define a shifted image, which is projected out of the front surface of the image shifting lens. The bi-functional lamp can include a first light source arranged to emit first light toward the reflector, which is reflected by the reflector and transmitted through the axial symmetric lens. A portion of the first light reflected from the reflector can be blocked and prevented from being transmitted to the axial symmetric lens by the physical shield. The first light transmitted through the axial symmetric lens can define a low beam illumination pattern. The bi-functional lamp can include a second light source arranged axially between the physical shield and the image shifting lens and arranged to emit light through the image shifting lens. The second light source can be configured to emit light through the image shifting lens, which can define a high beam illumination pattern. A portion of the high beam illumination pattern can be overlaid on the low beam illumination pattern.

In some aspects, the bi-functional lamp can include an optical ring having a hole directed therethrough. The optical ring can surround a first light source and a second light source. The optical ring can be positioned between an axial symmetric lens and the first light source. A first plurality of light sources can be positioned within a housing and can surround the second light source. The first plurality of light sources can emit light having a different color than light emitted from the first light source and the second light source. The first plurality of light sources can be configured to emit amber light. The first light source and the second light source can be configured to emit white light.

In some aspects, a focal point of an axial symmetric lens can axially align with an edge of the physical shield.

In some aspects, a focal point of an axial symmetric lens can be located axially between a first light source and a second light source.

In some aspects, a bi-functional lamp can include a wall that can extend downwardly towards an optical axis and that can be arranged within a housing. A second light source can be coupled to a surface of the wall.

In some aspects, an image shifting lens can include one or more supports extending from opposing sides of a lens portion of the image shifting lens. The one or more supports can be coupled to the surface of a wall.

In some aspects, a first and a second light source can be light emitting diodes.

In some aspects of the disclosure, a bi-functional lamp for a vehicle is provided. The lamp can include a housing having a first end and a second end, and an axial symmetric lens coupled to the first end of the housing and defining an optical axis and a focal point. The lamp can include a reflector arranged within the housing and positioned adjacent to the second end of the housing, a physical shield arranged within the housing, and an image shifting lens arranged within the housing. The image shifting lens can be positioned axially between the axial symmetric lens and the physical shield. The lamp can include a first light source arranged to emit light toward the reflector, and a second light source arranged axially between the physical shield and the image shifting lens and arranged to emit light through the image shifting lens. The second light source can be configured to emit light that defines an image through the image shifting lens. The image shifting lens can be configured to shift the image back to the focal point of the axial symmetric lens, and the image can define a high beam illumination pattern. The first light source can be configured to emit light that is reflected by the reflector and transmitted through the axial symmetric lens. A portion of the reflected light can be blocked and prevented from being transmitted to the axial symmetric lens by the physical shield. The reflected light can define a low beam illumination pattern. A portion of the high beam illumination pattern can be overlaid on the low beam illumination pattern.

The foregoing and other aspects and advantages of the disclosure will appear from the following description. In the description, reference is made to the accompanying drawings which form a part hereof, and in which there is shown by way of illustration a preferred configuration of the disclosure. Such configuration does not necessarily represent the full scope of the disclosure, however, and reference is made therefore to the claims and herein for interpreting the scope of the disclosure.

BRIEF DESCRIPTIONS OF THE DRAWINGS

DETAILED DESCRIPTION

Figure 1:
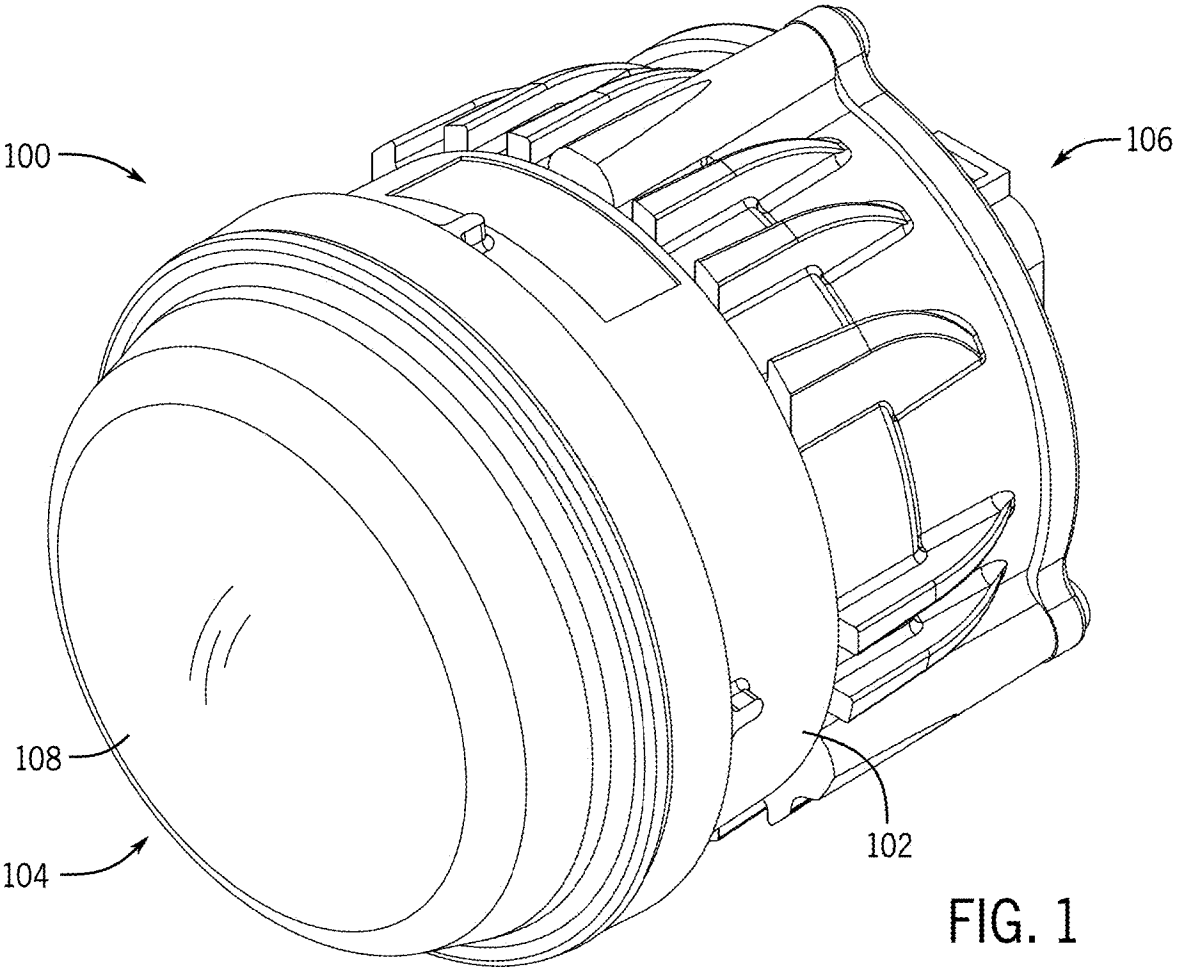
FIG. 1 is a top, front, left isometric view of a bi-functional lamp for a vehicle, in a fully assembled configuration.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use aspects of the present disclosure. Various modifications to the illustrated configurations will be readily apparent to those skilled in the art, and the generic principles herein can be applied to other configurations and applications without departing from aspects of the present disclosure. Thus, aspects of the present disclosure are not intended to be limited to configurations shown, but are to be accorded the widest scope consistent with the principles and features disclosed herein. The following detailed description is to be read with reference to the figures, in which like elements in different figures have like reference numerals. The figures, which are not necessarily to scale, depict selected configurations and are not intended to limit the scope of the present disclosure. Skilled artisans will recognize the non-limiting examples provided herein have many useful alternatives and fall within the scope of the present disclosure.

The use herein of the term "axial" and variations thereof refers to a direction that extends generally along an axis of symmetry, a central axis, or an elongate direction of a particular component or system. For example, an axially-extending structure of a component can extend generally along a direction that is parallel to an axis of symmetry or an elongate direction of that component. Similarly, the use herein of the term "radial" and variations thereof refers to directions that are generally perpendicular to a corresponding axial direction. For example, a radially extending structure of a component can generally extend at least partly along a direction that is perpendicular to a longitudinal or central axis of that component. The use herein of the term "circumferential" and variations thereof refers to a direction that extends generally around a circumference or periphery of an object, around an axis of symmetry, around a central axis, or around an elongate direction of a particular component or system.

Conventional headlamps can include inefficiencies (e.g., optical inefficiencies). For example, conventional headlamps can suffer from difficulties with ensuring that when both a high beam and a low beam are simultaneously produced that they are both properly overlaid. In other words, because each lamp has their own optical components (e.g., lenses), and are located at different positions on the vehicle, it can be difficult to ensure that the combined light pattern from the activation of both the high beam and the low beam is properly overlaid. Thus, at times, when the high beam and the low beam are simultaneously produced, gaps and other undesirable spatial relationships between the high beam and the low beam can occur (e.g., lateral translations, vertical translations, etc.).

Some recent approaches have attempted to address some of the problems above by constructing a headlamp that has both a high beam and a low beam configuration. In these cases, these headlamps have a movable physical shield or a light shield. In this configuration, the position of the physical movable shield determines whether a high beam or a low beam light pattern is produced. More specifically, if the physical moveable shield obstructs a portion of the light emitted from the light source, then a low beam light pattern is produced. Alternatively, if the physical moveable shield is moved or positioned so that no light or minimal light is obstructed, then a high beam light pattern is produced. While these configurations (with movable shields) allow for a selective high and low beam configuration, the moveable components can be undesirable. For example, because the physical shield has to be physically moved from one position to the next, the power requirements (e.g., by activation of an electrical actuator) are higher than systems without such moving components. As another example, the moving components can reduce lamp longevity, at least because repeated actuation of the physical shield, many times, can cause the lamp to ultimately fail. As yet another example, these systems have a relatively uniform illumination pattern near central regions. In other words, because there is only a single light source, the illumination pattern is largely the same between regions and depends on the natural diffusion of light.

Some non-limiting examples of the disclosure provide advantages over the conventional configurations, and others, by providing a bi-functional lamp that can selectively produce a low beam illumination pattern, a high beam illumination pattern, or both simultaneously, without the need for movable components (e.g., the movable light shields). Additionally, some non-limiting examples of the disclosure provide a more compact design (axially). In other words, the bi-functional lamp has a decreased axial spatial footprint, as compared to conventional configurations.

FIG. 1 shows a front perspective view of a bi-functional lamp 100 for a vehicle (not shown) in a fully assembled configuration. The bi-functional lamp 100 can include a housing 102 having a first end 104 (e.g., a front end) and a second end 106 (e.g., a rear end), and a front cover 108. The housing 102 can be generally configured to retain and secure the components of the bi-functional lamp 100, and can be formed out of any suitable materials (e.g., plastics, metals, etc.). The front cover 108 can be coupled to the first end 104 of the housing 102 and is substantially (i.e., deviating by less than 10% from) transparent so as to allow light produced within the bi-functional lamp 100 to be emitted through the front cover 108.

Figure 2:
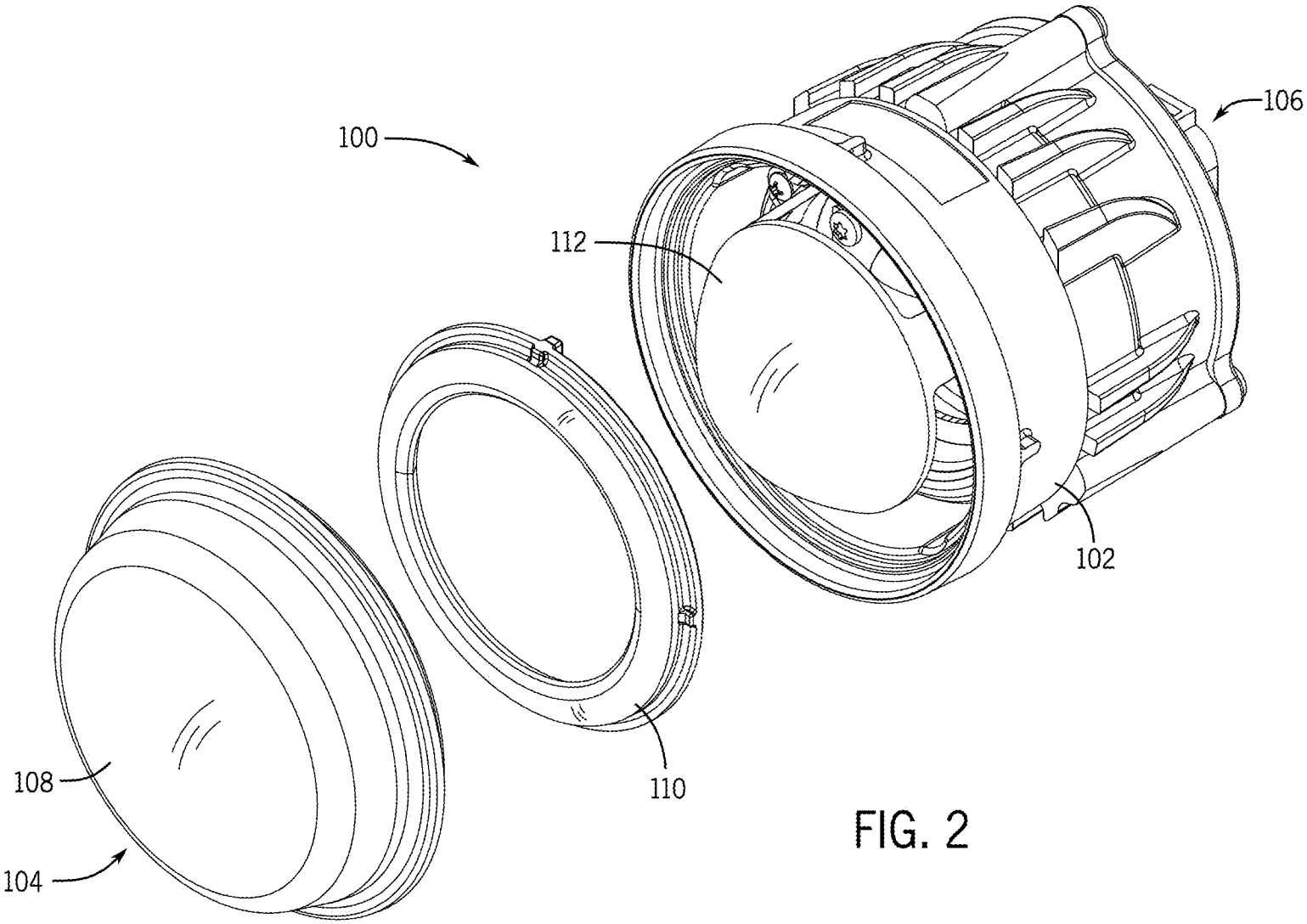
FIG. 2 is an exploded top, front, left isometric view of the bi-functional lamp of FIG. 1.
Figure 3:
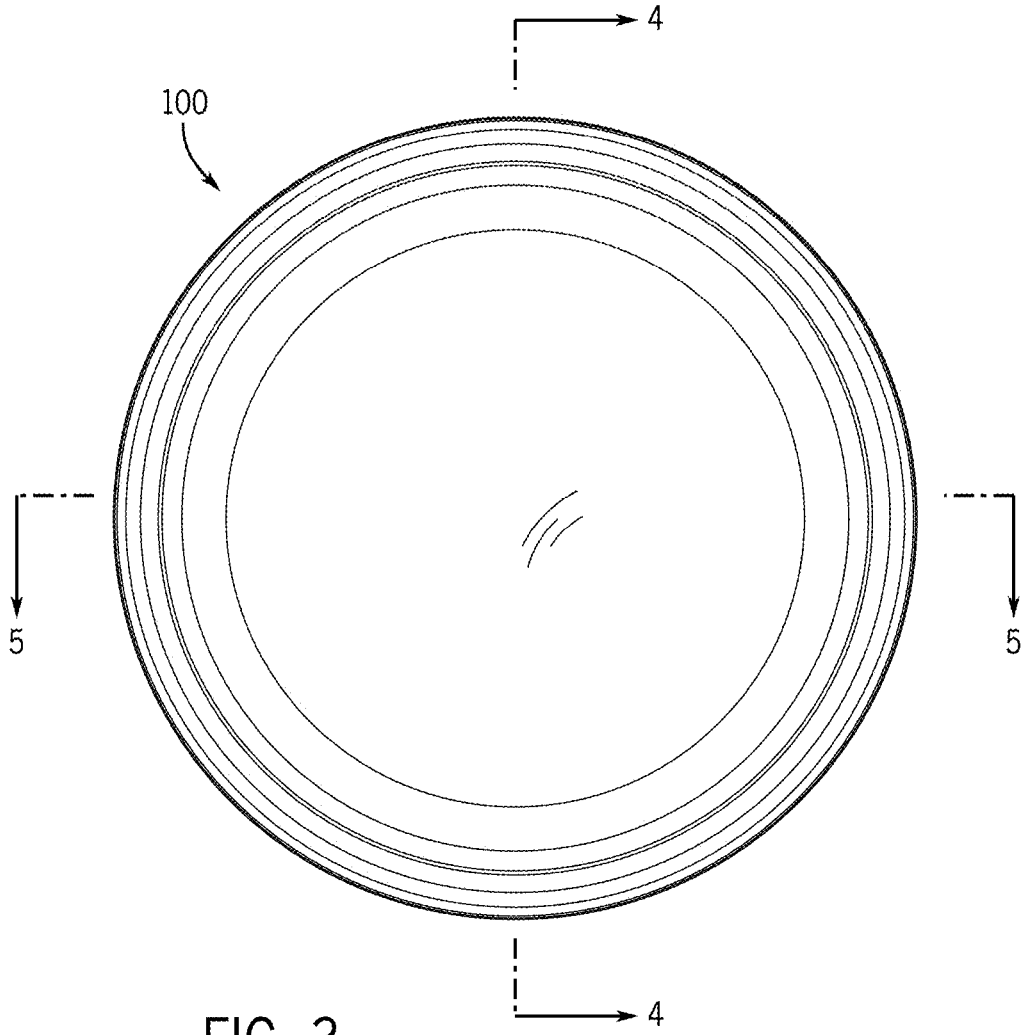
FIG. 3 is a front view of the bi-functional lamp of FIG. 1.
Figure 4:
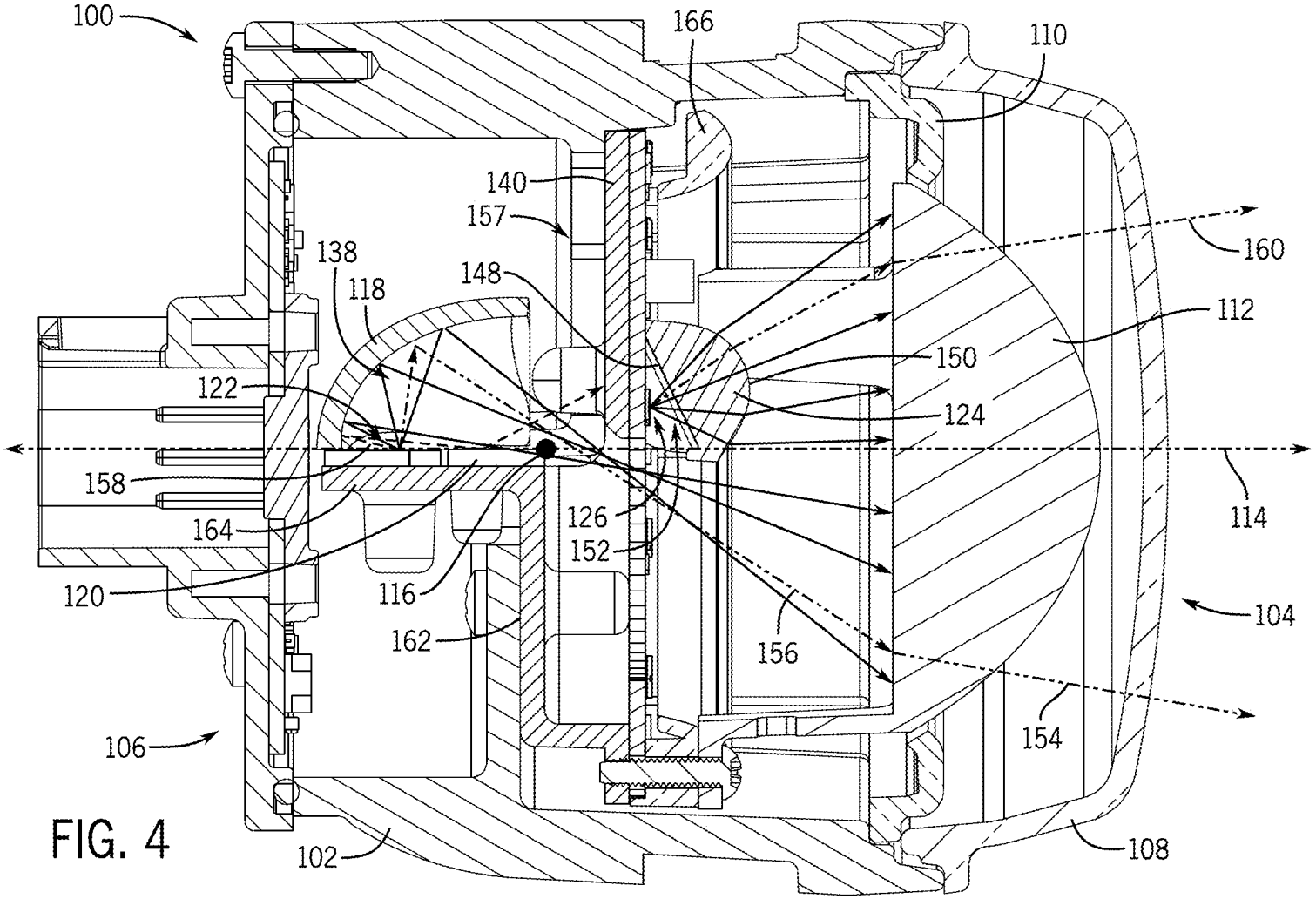
FIG. 4 is a cross-sectional view of the bi-functional lamp of FIG. 1, taken along line 4-4 of FIG. 3.

Turning to FIGS. 2-4, the bi-functional lamp 100 can include an optical ring 110, and an axial symmetric lens 112 defining an optical axis 114 (see FIG. 4) and a focal point 116 (see FIG. 4). The optical ring 110 can be coaxially positioned in the housing 102 relative to the axial symmetric lens 112, when the bi-functional lamp 100 is fully assembled. In some cases, a portion of the axial symmetric lens 112 is inserted through a hole of the optical ring 110 that is directed through the optical ring 110. In other words, an inner circumference of the optical ring 110 (see FIG. 4) can define the hole of the optical ring 110, in which a portion of the axial symmetric lens 112 is inserted through. The optical ring 110 can be a transparent optical component that is configured to produce multiple intensities of light. For example, although not shown in FIG. 2, the bi-functional lamp 100 includes light sources (e.g., amber light sources), which can direct emit light towards and through the optical ring 110 at different light intensities, as described below. In some non-limiting examples, the optical ring 110 can define a peripheral lip around a portion of or the entire circumference of the optical ring 110.

The axial symmetric lens 112 can be coupled to the housing 102, which can be implemented in different ways. For example, as described in below, the axial symmetric lens 112 can be coupled to the housing 102 via one or more fasteners (e.g., threaded fasteners). In some non-limiting examples, the axial symmetric lens 112 can define a cross-sectional shape that is substantially uniform around the optical axis 114. In other words, the axial symmetric lens 112 can be formed by revolving a quarter of the cross-section of the axial symmetric lens 112 around the entire optical axis 114 (e.g., 360 degrees). As shown in FIG. 2, the axial symmetric lens 112 is positioned behind the front cover 108, but is positioned in front of many of the other components of the bi-functional lamp 100. For example, the axial symmetric lens 112 is positioned in front of each of the light sources of the bi-functional lamp 100, however, other configurations are possible.

With specific reference to FIG. 4, the bi-functional lamp 100 can include a reflector 118, a physical shield 120, a light source 122, an image shifting lens 124, and a light source 126. The reflector 118 can be arranged within the housing 102 behind the axial symmetric lens 112, the image shifting lens 124, the focal point 116 of the axial symmetric lens 112, and the light source 126. In some configurations, the reflector 118 can be positioned near or adjacent to the second end 106 of the housing 102. While the reflector is shown as having a shell-like structure, other configurations are possible. For example, the reflector 118 can define a hemi-ellipsoid, while in other cases, including as shown in FIG. 4, the reflector 118 can define a quarter ellipsoid. In other words, the reflector 118 that is substantially a quarter ellipsoid can be created by separating an ellipsoid at its equator (or in other words the semi major axis of the ellipsoid) to define an upper and lower half, and then further separating one of the halves at the prime meridian of the half (or in other words the semi minor axis of the ellipsoid) to yield a (substantially) quarter ellipsoid. In some cases, the substantially or exactly quarter ellipsoid for the reflector 118 can be advantageous in that the spatial footprint of the reflector can be decreased, while still being able to produce a low beam illumination pattern. Regardless of the configuration, the reflector 118 can define a reflection surface, and an internal volume. For example, light, including light produced by the light source 122, can be reflected and redirected by the reflection surface of the reflector 118.

As shown in FIG. 4, the physical shield 120 can be positioned within the housing 102 and can be oriented generally parallel to the optical axis 114. In some cases, and as illustrated, the physical shield 120 can be positioned behind the axial symmetric lens 112, behind the image shifting lens 124, and behind the light source 126. In addition, the physical shield 120 can be positioned in front of the light source 122, and in front of a portion of the reflector 118. In some non-limiting examples, the physical shield 120 can be partially received within the internal volume defined by of the reflector 118, such that a portion of the physical shield 120 extends out from the internal volume of the reflector 118. This portion of the physical shield 120 that extends out from the internal volume of the reflector 118 can define an extension 127, which can include an edge that aligns with the optical axis 114 and the focal point 116 of the axial symmetric lens 112. In this way, because the edge of the physical shield 120 overlaps with the focal point 116, the physical shield 120 can provide a crisper cut off for the low beam illumination pattern. In addition, because the physical shield 120, which can be substantially planar, is oriented to be substantially parallel with the optical axis 114 of the axial symmetric lens 112 (and substantially perpendicularly to the direction of gravity), the physical shield 120 can be better supported and thus is impacted to a lesser extent by vibrational or other forces (e.g., as compared to physical shields that extend substantially perpendicular to an optical axis).

Figure 5:
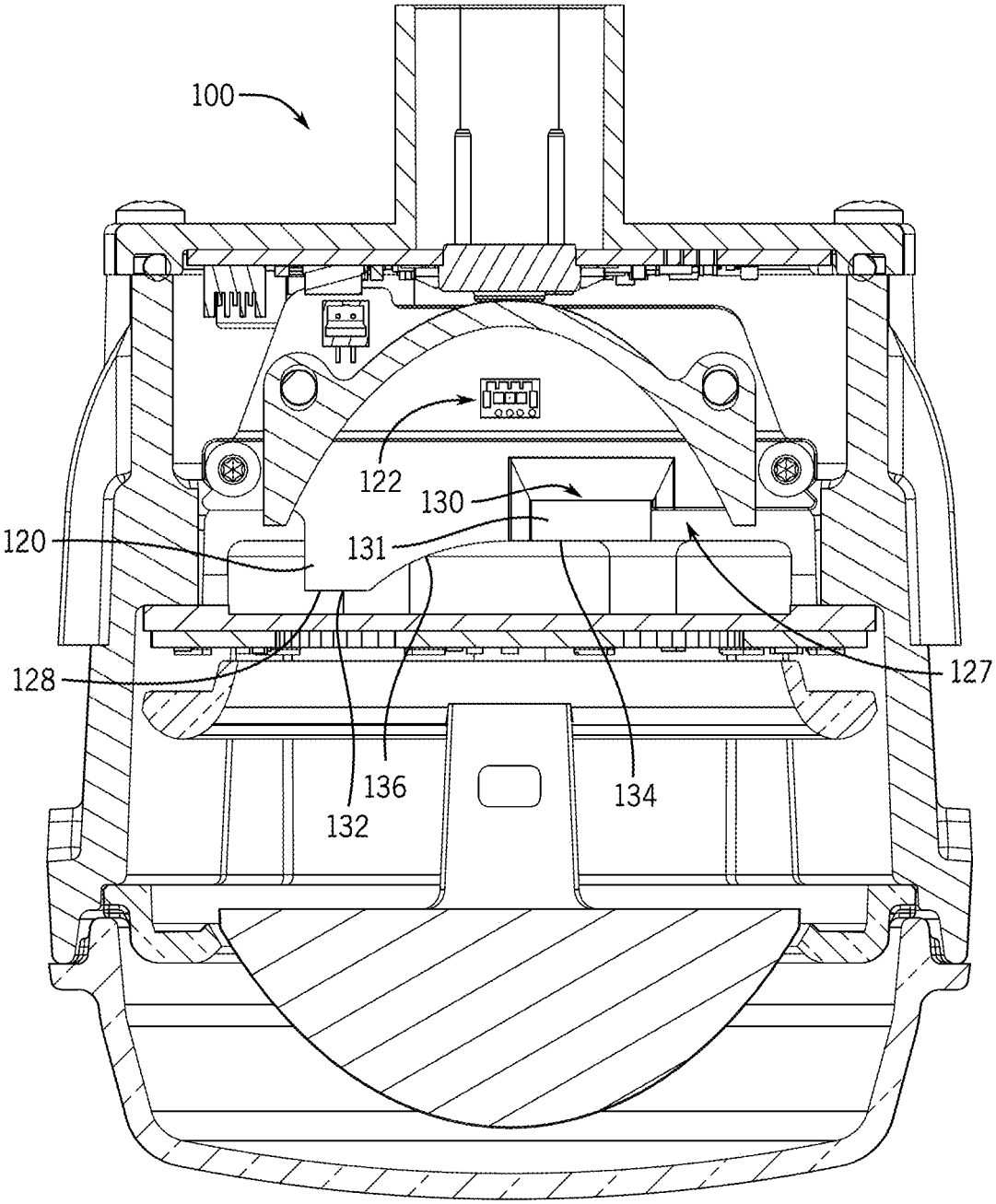
FIG. 5 is a top cross-sectional view of the bi-functional lamp of FIG. 1, taken along line 5-5 of FIG. 3.

FIG. 5 shows a top cross-sectional view of the bi-functional lamp 100 in a fully assembled configuration to show the shape of the physical shield 120. As shown in FIG. 5, the physical shield 120 can include the extension 127 which can define a peripheral edge 128 and at least a portion of a well 130. The extension 127, including the peripheral edge 128, can extend out of the internal volume of the reflector 118 in a direction along the optical axis 114 and towards the axial symmetric lens 112. For example, the peripheral edge 128 can be the edge of the physical shield 120 that is farthest away, along the optical axis 114, from the light source 122. The peripheral edge 128 can include linear regions 132, 134 that are joined together by a curved region 136 that is concave. Generally, the peripheral edge 128 of the physical shield 120 can define the shape or spatial illumination distribution of the light emitted from the light source 122 and reflected by the reflector 118. In particular, some light that is reflected by the reflector 118 can be blocked (e.g., reflected) by the physical shield 120, and thus the shape of the physical shield 120 (e.g., how far the physical shield 120 extends away from the reflector 118) dictates the shape of the light pattern projected from the axial symmetric lens 112. In other words, at least some light that is emitted from the light source 122, reflected by the reflector 118, and directed at the physical shield 120 is not transmitted through the axial symmetric lens 112 (e.g., but is rather reflected off from, or absorbed by, the physical shield 120 and is directed away from the axial symmetric lens 112). In some non-limiting examples, the physical shield can be formed out of a polymer (e.g., a plastic), in which case the physical shield 120 can absorb light emitted from the light source 122). In other cases, the physical shield 120 can be formed out of a metal, in which case the physical shield 120 can reflect light off the physical shield 120 (e.g., that is not intended to be transmitted through the axial symmetric lens 112). In some configurations, the ability of the physical shield 120 to reflect light (rather than absorbing the light), can be advantageous in that the temperature of the physical shield 120 does not undesirably increase (e.g., which could undesirably heat other nearby components).

The well 130 can be arranged adjacent to the linear region 134 of the peripheral edge 128 of the physical shield 120. The well 130 can include sloping (angled) faces that meet at a central location, which defines a portion of the linear region 134 of the peripheral edge 128. Stated another way, the well 130 can define a number of facets that are angled towards the central location. At the central location, the well 130 defines a planar surface 131. In some cases, the thickness of the physical shield 130 at the planar surface 131 (or at other portions of the well 130) can be less than the thickness of a different portion of the well 130 (e.g., a portion of the well 130 not a the well 130). In this way, the decreased thickness provided by the well 130 can provide increased illumination to a particular region and can provide a better cut-off for the illumination pattern, as described below. For example, because the required illumination cut off for low beam regulations is 3-dimensional ("3D"), and because the edge 128 of the physical shield 120 (which follows the focal field of the axial symmetric lens 112) is itself 3D and has a particular thickness (e.g., greater than 1 millimeter), then more light is required generally, which is provided by the (geometry of the) well 130. In other words, due to the relatively small footprint of the well 130, and the well 130 defining a decreased thickness of the physical shield 120, a higher light region within the low beam illumination pattern is provided that has a crisp cut-off.

Referring back to FIG. 4, the bi-functional lamp 100 can include the light source 122 that is positioned within the housing 102, and that is located within the internal volume of the reflector 118. In some cases, the light source 122 can be arranged axially behind (e.g., toward the second end 106) of the physical shield 120 and the focal point 116 of the axial symmetric lens 112, relative to the optical axis 114. In addition, the light source 122 can be positioned behind the axial symmetric lens 112, behind the image shifting lens 124, behind the light source 126, and behind at least a portion of the reflector 118. In some cases, the light source 122 can have a light emission surface that is substantially parallel to the optical axis 114 As shown in FIG. 4, the light source 122, and the physical shield 120, can each be positioned below a reflecting surface of the reflector 118. In operation, the light source 122 can be directed to emit light toward the reflection surface of the reflector 118. This emitted light 138 can then be reflected by the reflector 118, directed below the optical axis 114, and transmitted through the axial symmetric lens 112. The portion of the light 138 that is eventually projected through and emitted out of the axial symmetric lens 112 can define a low beam illumination pattern. Importantly, the physical shield 120 blocks (e.g., reflects away) a portion of the light 138 that is reflected by the reflector 118 so as to prevent that portion of light 138 from being transmitted to (and through) the axial symmetric lens 112. Thus, the physical shield 120 causes a crisp or sharp cut-off for the low beam illumination pattern. In some non-limiting examples, the light source 122 can be a light emitting diode (LED) or can comprise multiple LEDs. However, in other configurations, the light source 122 can be an incandescent light bulb. In some cases, the light source 122 being at least one LED can be advantageous in that the spatial footprint of the bi-functional lamp 100, and in particular, the axial spatial footprint of the bi-functional lamp 100 (e.g., defined by the length between the ends 104, 106) can be greatly decreased because LEDs are typically much smaller than other light sources. In addition, LEDs can have superior temperature generation characteristics for a given illumination value (e.g., more efficient light generation).

In some non-limiting examples, the arrangement of the light source 122 within the housing 102 can be altered to emit light in a different direction. For example, the light source 122 can be arranged to emit light in a direction generally toward the axial symmetric lens 112 (e.g., in a direction that generally aligns with or is slightly angled relative to the optical axis 114). In these non-limiting examples, one or more lenses can be arranged between the light source 122 and the axial symmetric lens 112, rather than the reflector 118. Although a reflector 118 is described and illustrated as directing the light 138, in alternative non-limiting examples the reflector 118 can be substituted with other optics that elicit the same optical response, such as, for example, mirrors or other reflecting optics.

The bi-functional lamp 100 can include the image shifting lens 124 that is arranged within the housing 102 and can be located axially between the physical shield 120 and the axial symmetric lens 112. In addition, the image shifting lens 124 can be positioned behind the axial symmetric lens 112, in front of the light source 126, in front of the physical shield 120, in front of the focal point 116, in front of the light source 122, and in front of the reflector 118. In some configurations, a portion of the image shifting lens 124 can be positioned above the focal point 116 and above the optical axis 114. In some cases, including when the bi-functional lamp 100 includes a wall 140 (e.g., which is arranged within and coupled to the housing 102), the image shifting lens 124 can be positioned axially in front of the wall 140 (e.g., in a direction toward the first end 104). As shown in FIG. 4, the image shifting lens 124 has a rear surface 148 that is planar, and an opposing front surface 150 that is concave. In operation, light directed to the rear surface 148 in the form of an image has a focal point at substantially the location of the light source 126, which is positioned in front of the focal point 116. However, this image, when projected out of the front surface 150 defines a shifted image that has a focal point that substantially overlaps with the focal point 116 of the axial symmetric lens 112. In this way, the image shifting lens 124 shifts an image back to substantially the focal point 116 so that light emitted from the front surface 150 has a focal point that substantially overlaps with the focal point 116. In this way, the high beam illumination pattern overlaps well with the low beam illumination pattern.

In some non-limiting examples, the bi-functional lamp 100 can include the light source 126 that can be arranged within the housing 102 and can be located axially between the physical shield 120 and the image shifting lens 124. In some cases, the light source 126 can be positioned behind the axial symmetric lens 112, behind the image shifting lens 124, in front of the wall 140, in front of the focal point 116, in front of the physical shield 120, in front of the light source 122, and in front of the reflector 118. In some non-limiting examples, the light source 126 can be coupled to or supported by a surface the wall 140 that faces the axial symmetric lens 112, such that the light source 126 can be positioned axially between the image shifting lens 124 and the focal point 116 of the axial symmetric lens 112. In some configurations, the light source 126 can define a light emission surface that is substantially perpendicular to the optical axis 114. In some cases, the light source 126 can be implemented in a similar manner as the light source 122. For example, the light source 126 can be an LED, multiple LEDS, an incandescent bulb, etc.

In operation, the light source 126 can be arranged to emit light 152 toward the rear surface 148 of the image shifting lens 124. The emitted light 152 can then be transmitted to and through the image shifting lens 124 and emitted out of the front surface 150 of the image shifting lens 124 to define an image. In general as described above, the image shifting lens 124 can be configured shift the image back to substantially the focal point 116 of the axial symmetric lens 112. For example, the optical characteristics of the image shifting lens 124 can shift a focal point of the image projected from the image shifting lens 124 back to the focal point 116 of the axial symmetric lens 112, which overlaps the high beam pattern with the low beam pattern (e.g., the high beam pattern is overlapped with at least a portion of the low beam pattern). In this way, because the image emitted out of the front surface 150 of the image shifting lens 124 is shifted back to the focal point 116, light emitted from either of the light sources 122, 126 will be transmitted though the axial symmetric lens 112 with a similar focal point. So, both patterns of light emitted out of the axial symmetric lens 112 (assuming both light sources 122, 126 are emitting light)

will "appear" to have originated from a similar focal point, and thus both patterns will be overlaid in a better manner.

In some non-limiting examples, the image projected out of the front surface 150 can be directed to the axial symmetric lens 112. This image is then transmitted through and is projected out of the axial symmetric lens 112 to define a high beam illumination pattern. In some cases, the projected image, from the image shifting lens 124 and to the axial symmetric lens 112, is located only above the optical axis 114. In other cases, the projected image to the axial symmetric lens 112 is located in a region that spans above and below (and includes) the optical axis 114.

As shown in FIG. 4, the light source 122 is configured to emit light along an optical path 154. The optical path 154 can extend from the light source 122, towards the reflector 118 (e.g., the reflective surface of the reflector 118), towards the axial symmetric lens 112 (e.g., after reflecting off of the reflective surface of the reflector 118), and through the axial symmetric lens 112 to define a low beam illumination pattern (e.g., after the light is projected out of the axial symmetric lens 112). A portion of the optical path 154, and in particular the portion 156 between the reflector 118 and the axial symmetric lens 112, can cross the optical axis 114 at a downwards angle relative to the optical axis 114. Thus, a section of the portion 156 of the optical path 154 extends above the optical axis 114, while a section of the portion 156 of the optical path 154 extends below the optical axis 114. In addition, the portion 156 of the optical path 154 can extend through a gap 157 that is positioned between the wall 140 and a shelf 164 of a support 162. While only one optical path 154 has been described, it should be understood that light emitted from the light source 122 can follow multiple light paths that each follow a similar path as the optical path 154 (e.g., but are shifted in space) to define the low beam illumination pattern.

As shown in FIG. 4, the light source 122 is also configured to emit light along an optical path 158. The optical path 158 can extend from the light source 122, towards the reflector 118, towards the physical shield 120 (e.g., after reflecting off the reflective surface of the reflector 118), and away from the physical shield 120 (or stopping at the physical shield 120, including when the light is absorbed by the physical shield 120). In this way, light that follows the optical path 158 advantageously is not transmitted through the axial symmetric lens 112, so that the low beam illumination pattern has a crisp cut-off. In other words, the physical shield 120 blocks light that follows the optical path 158 from being transmitted through the axial symmetric lens 112.

The light source 126 is also configured to emit light along an optical path 160. For example, the optical path 160 can extend from the light source 126, towards the image shifting lens 124, through the image shifting lens 124, towards the axial symmetric lens 112, and through the axial symmetric lens 112 to define a high beam illumination pattern. As shown in FIG. 4, the optical path 158 extends above the optical axis 114 (e.g., and does not extend below the optical axis 114). However, in alternative configurations, the optical path 160 can extend below the optical axis 114 (e.g., so that the high beam illumination pattern is overlaid on the low beam illumination pattern). Similarly to the optical path 154, while only one optical path 160 has been described, it should be understood that light emitted from the light source 126 can follow multiple light paths that each follow a similar path as the optical path 160 (e.g., but are shifted in space) to define the high beam illumination pattern.

In some non-limiting examples, the bi-functional lamp 100 can include the wall 140, and a support 162, each of which can be positioned within and coupled to the housing 102. The wall 140 can be positioned behind the axial symmetric lens 112, behind the image shifting lens 124, behind the light source 126, in front of the focal point 116, in front of the physical shield 120, in front of the light source 122, and in front of the reflector 118. The wall 140 can be oriented substantially perpendicularly to the optical axis 114, and as described above, the light source 126 can be coupled to the wall 140 so that the light source 126 faces the axially symmetric lens 112. The support 162 can include a shelf 164 that extends away from the axial symmetric lens 112 in a direction that is parallel to the optical axis 114. In particular, the shelf 164 can define a planar surface that is substantially parallel to the optical axis 114. As shown in FIG. 4, the reflector 118, the light source 122, and the physical shield 120 can be coupled to the shelf 164, and in particular, the planar surface of the shelf 164. Although not visible in FIG. 4, the wall and the support 162 can be integrally formed together. Thus, in some cases, the wall 140 can be part of the support 162 (e.g., the support 162 encompassing the wall 140). In this way, the spatial positioning between the components of the bi-functional lamp 100 including the light sources 122, 126 are continually maintained without the risk of changing over time (e.g., such as if the components were coupled together). In some cases, the wall 140 can be coupled to the support 162.

Figure 6:
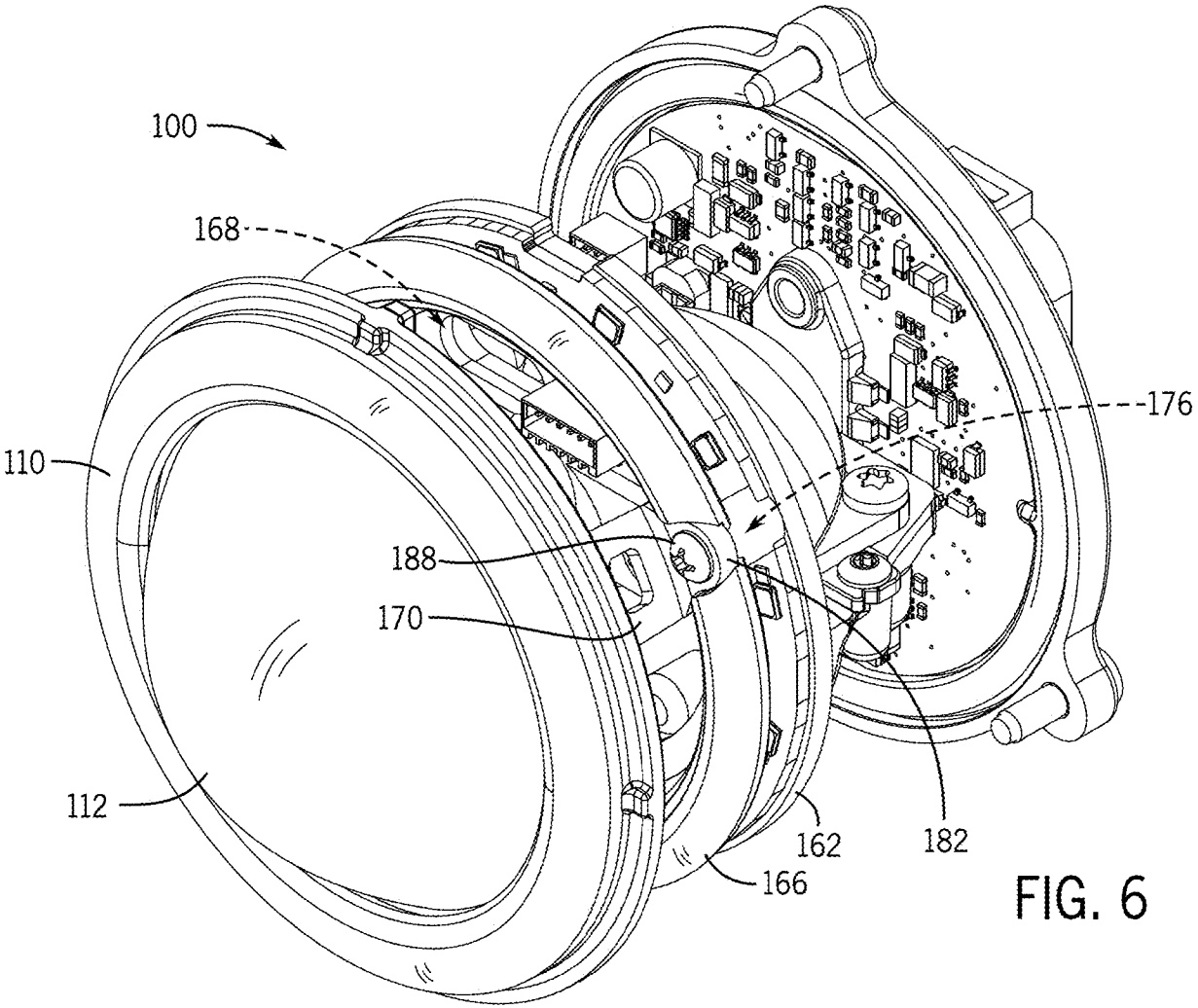
FIG. 6 is a front isometric view of the bi-functional lamp of FIG. 1, fully assembled, with some components removed for visual clarity.
Figure 7:
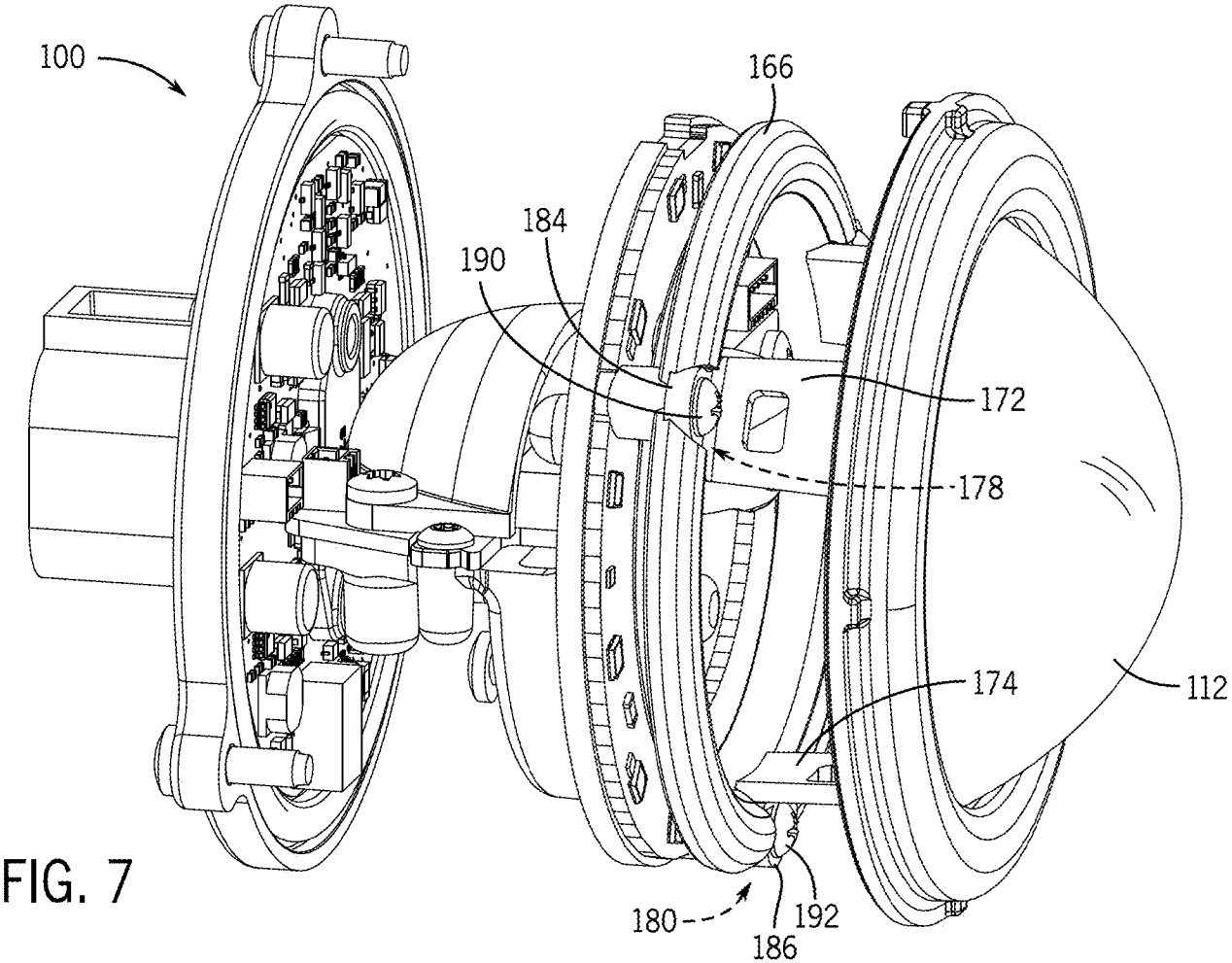
FIG. 7 is a rear isometric view of the bi-functional lamp of FIG. 1, fully assembled, with some components removed for visual clarity.

FIGS. 6 and 7 show isometric views of the bi-functional lamp 100 with the housing 102 and front cover 108 removed for visual clarity. In some non-limiting examples, the bi-functional lamp 100 can include an optical ring 166 having a hole 168 directed therethrough. Although not shown in FIG. 6, the optical ring 166 can be positioned within and coupled to the housing 102. The optical ring 166 can be positioned behind the axial symmetric lens 112, in front of the wall 140, in front of the physical shield 120, in front of the focal point 116, in front of the light source 122, and in front of the reflector 118. In addition, the optical ring 166 can be positioned so that the optical ring 166 can surround the light sources 122, 126, the image shifting lens 124, the physical shield 120, the focal point 116, and the reflector 118.

As shown in FIGS. 6 and 7, the axial symmetric lens 112 includes legs 170, 172, 174, while the optical ring 166 includes recesses 176, 178, 180. Each leg 172, 174, 176 nests within a respective recess 176, 178, 180 to secure the axial symmetric lens 112 relative to the optical ring 166. In particular, each leg 170, 172, 174 includes a respective protrusion 182, 184, 186 that is received within the respective recess 176, 178, 180. Then, a respective fastener 188, 190, 192, each of which can be a threaded fastener, can be inserted through a leg and a recess and engaged with the support 162 (e.g., threadingly engaged with the support 162) to secure the axial symmetric lens 112, and the optical ring 166 to the support 162. For example, the fastener 188 can be inserted through the leg 170 (e.g., and in particular the protrusion 182) and the recess 176 of the optical ring 166, the fastener 190 can be inserted through the leg 174 (e.g., and in particular the protrusion 184) and the recess 178 of the optical ring 166, and the fastener 192 can be inserted through the leg 174 (e.g., and in particular the protrusion 186) and the recess 180 of the optical ring 166. Regardless of the configuration, the axial symmetric lens 112 can be coupled to the support 162, and the optical ring 166 can be coupled to the support 162. In some cases, with the axial symmetric lens 112 having legs coupled the support 162, a relatively constant distance can be maintained between the support 162 and the lens portion of the axially symmetric lens 112. In addition, with the legs and recess configuration, the axial symmetric lens 112 can be advantageously constrained relative to each other.

Figure 8:
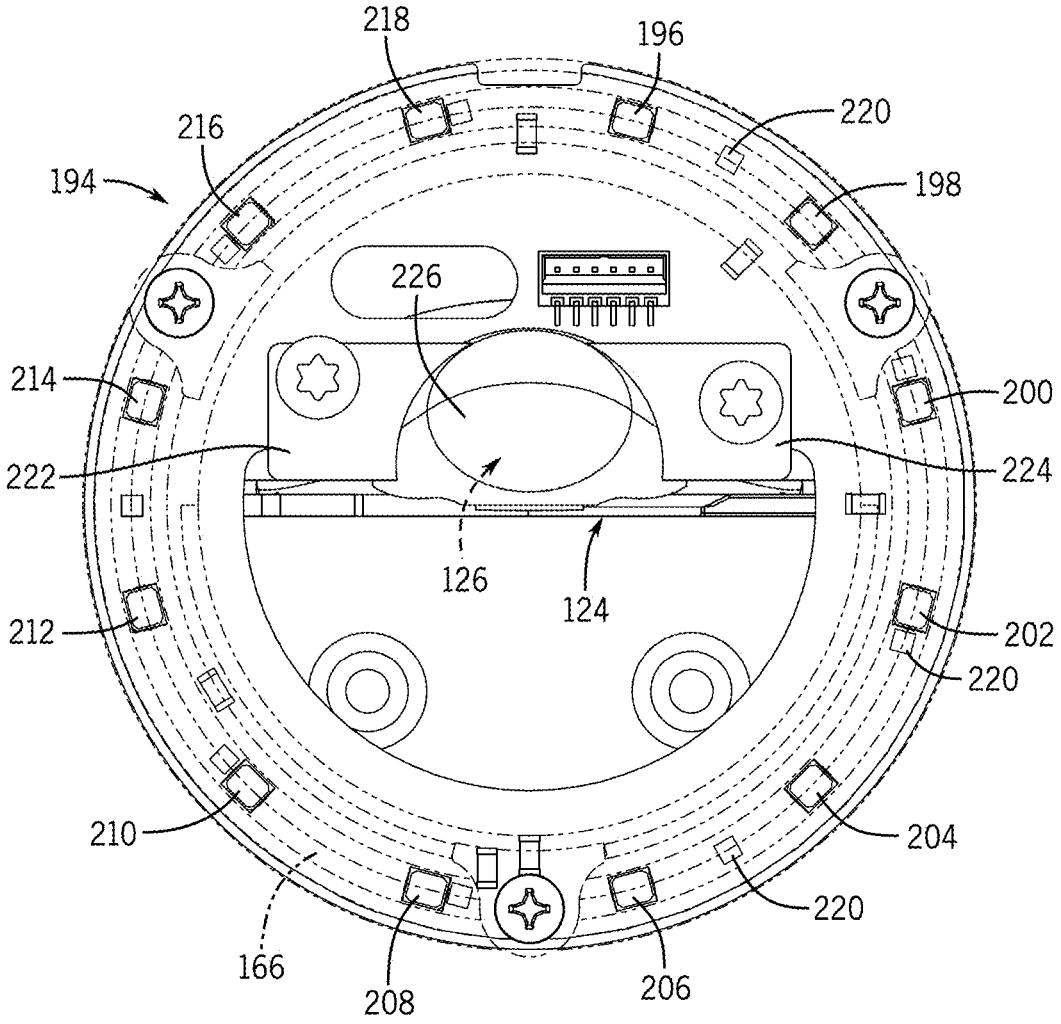
FIG. 8 is a front view of an assembly that includes the optical ring and the support of the bi-functional lamp of FIG. 1.

FIG. 8 shows a front view of the optical ring 166 and the support 162 of the bi-functional lamp 100. As shown in FIG. 8, the optical ring 166 has been shown to be transparent to better illustrate the components situated behind the optical ring 166. For example, the bi-functional lamp 100 can include a plurality of light sources 194 positioned within the housing 102, which can include light sources 196, 198, 200, 202, 204, 206, 208, 210, 212, 214, 216, 218. Each light source of the plurality of light sources 194 can be situated behind the optical ring 166. In addition, each light source of the plurality of light sources 194 can be positioned behind the axial symmetric lens 112, in front of the focal point 116, in front of the physical shield 120, in front of the reflector 118, and in front of the light source 122. In some cases, the plurality of light sources 194 can be positioned to surround the light source 126, surround the image shifting lens 124, surround the light source 122, surround the focal point 116, and surround the reflector 118. While the plurality of light sources 194 are illustrated as having twelve light sources, the light sources 194 can include other numbers of light sources including nine light sources, six light sources, four light sources, and even, in some cases, a single light source. In some non-limiting examples, each light source of the plurality of light sources 194 can be implemented in a similar manner as the light sources 122, 126. For example, each light source of the light sources 194 can be an LED, incandescent bulb, etc.

Each light source of the plurality of light sources 194 can be configured to emit light having a different color than the light emitted from the light source 122, the light source 126, or both. For example, each light source of the plurality of light sources 194 can be configured to emit amber light, while the light source 122, and the light source 126 can be configured to emit white light.

In some non-limiting examples, the bi-functional lamp 100 can include a plurality of light sources 220 different from the light sources 122, 126, and the plurality of light sources 194. The plurality of light sources 220 can also be positioned within the housing 102, and can be coupled to the support 162 The plurality of light sources 220 can be positioned behind the optical ring 166, behind the axial symmetric lens 112, in front of the wall 140, in front of the focal point 116, in front of the physical shield 120, in front of the reflector 118, and in front of the light source 122. Although the plurality of light sources 220 can include nine light sources, the plurality of light sources 220 can include other numbers of light sources including six, and even in some cases, one light source. Each light sources of the plurality of light sources 220 can be configured to emit light that is different from the light emitted by each of the light sources 194. For example, each light source of the plurality of light sources 220 can be configured to emit white light. Regardless of the configuration, light emitted from a light source of the plurality of light sources 194 can follow an optical path that extends through the optical ring 166, and through the axial symmetric lens 112 (or the optical ring 110). Similarly, light emitted from a light source of the plurality of light sources 220 can follow an optical path that extends through the optical ring 166, and through the axial symmetric lens 112 (or the optical ring 110). In some non-limiting examples, each light source of the plurality of light sources 220 can be implemented in a similar manner as the light sources 122, 126. For example, each light source of the light sources 220 can be an LED, incandescent bulb, etc.

In some embodiments, the lamp 100 can be configured to emit a parking light illumination pattern, a directional indication illumination pattern, a brake illumination pattern, etc. For example, causing the one or more of the light sources 194, 220 to emit light can generate a parking illumination pattern (e.g., a parking light illumination pattern), a directional indication illumination pattern (e.g., when the driver initiates a turn signal, and when the lights 122, 126 are on or off), a brake light illumination pattern, etc. In this way, with the bi-functional lamp 100 able to emit various illumination patterns, the total footprint for lamps the vehicle can be further decreased by using the bi-functional lamp 100. In other words, the vehicle does not need to have a separate high beam light, a separate low beam light, and a separate parking light, etc.

In some non-limiting examples, the image shifting lens 124 can be coupled to the support 162, and in particular, the wall 140 of the support 162. For example, the image shifting lens 124 can include arms 222, 224 that extend from respective sides of a lens portion 226 of the image shifting lens 124. In some non-limiting examples, the arms 222, 224 can be coupled (via fasteners, including threaded fasteners) to a front surface of the wall 140 (e.g., facing the axial symmetric lens 112) to ensure that the lens portion 226 of the image shifting lens 124 is secure, without obscuring light projected through the front surface of the image shifting lens 124. In addition, the arms 222, 224 can be monolithic (or in other words integrally formed) with the lens portion 226. In this way, it is ensured that, over time, the position between the arms 222, 224 and the lens portion 226 are maintained (e.g., a coupling mechanism between the arms 222, 224 and the lens portion 226 does not fail over time to undesirably change the position between these components).

Figure 9:
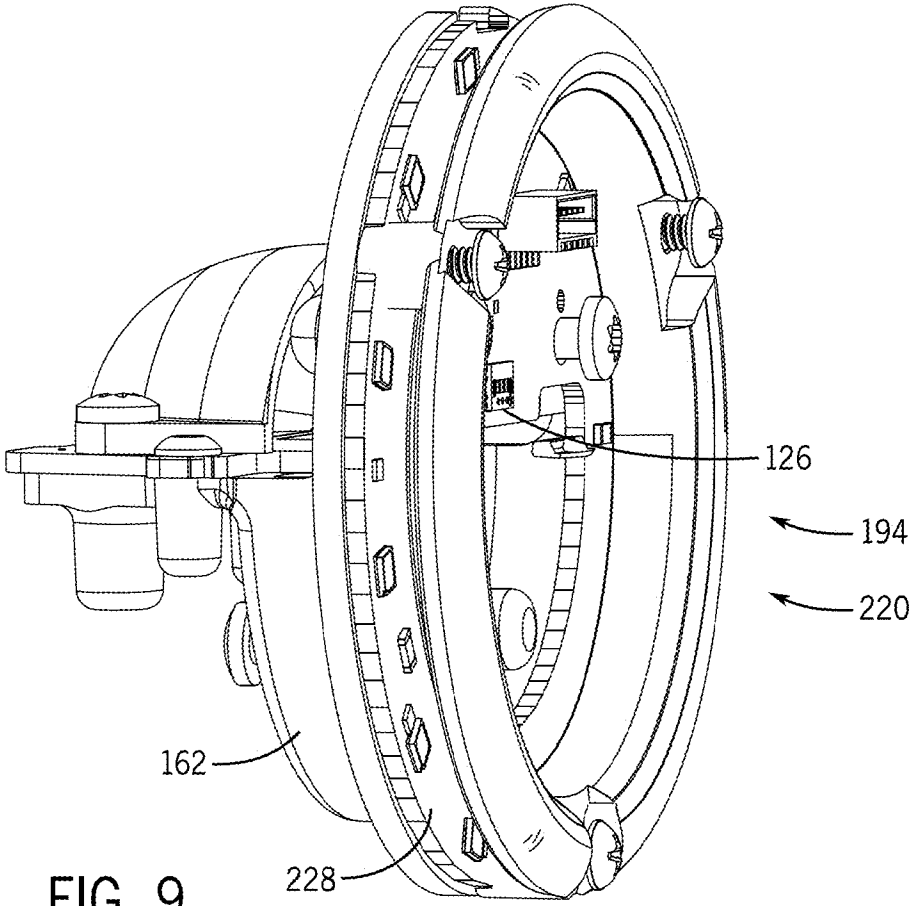
FIG. 9 is a rear perspective view of the assembly of FIG. 8.

FIG. 9 shows a perspective view of the support 162 with various light sources coupled thereto. For example, the bi-functional lamp 100 can include a circuit board 228 that supports and provides an electrical connection for the light source 126, and the plurality of light sources 194, 220. As a more specific example, each light source of the light source 126, and the plurality of light sources 194, 220 can be coupled to the circuit board 228 and electrically connected to the circuit board 228. Then, the circuit board 228, with the light sources coupled thereto, can be coupled to the support 162 (e.g., a surface of the support 162 that faces the axial symmetric lens 112).

Figure 10A:
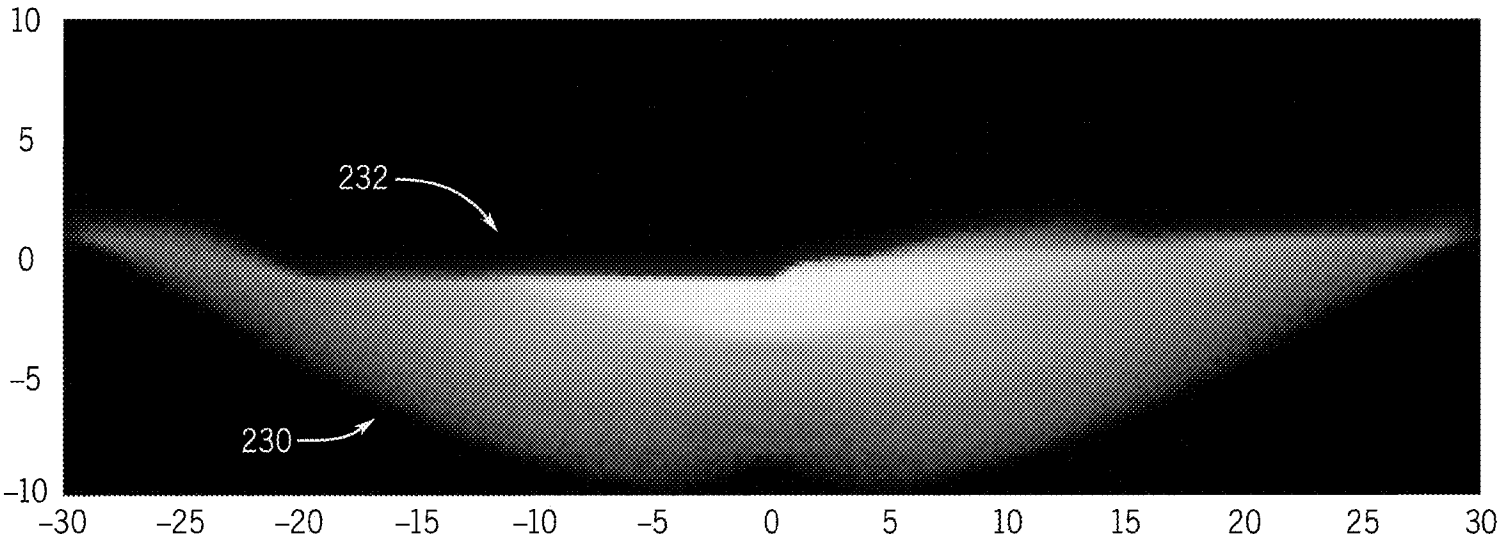
FIG. 10A is a graph illustrating a low beam illumination pattern produced by the bi-functional lamp of FIG. 1.
Figure 10B:
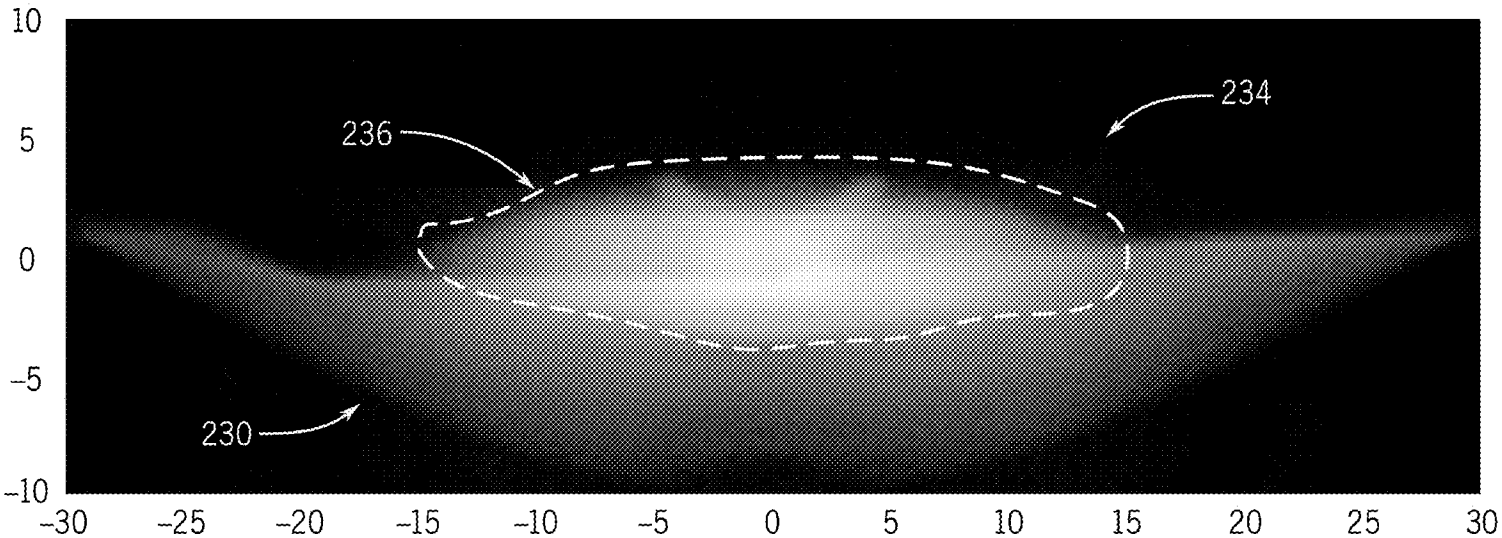
FIG. 10B is a graph illustrating a combined light pattern including a low beam illumination pattern and a high beam illumination pattern produced by the bi-functional lamp of FIG. 1.

FIGS. 10A and 10B show two graphs of two different light patterns produced by the bi-functional lamp 100. FIG. 10A shows a low beam illumination pattern 230, which is produced using only the light source 122 (e.g., the light source 126 is turned off). As shown, the low beam illumination pattern 230 has a sharp cut-off region 232 that can be provided by the physical shield 120. In other words, the physical shield 120 can block light reflected by the reflector 118 to cause a substantially straight (i.e., deviating by less than 10°) cut-off region 232 for the projected low beam illumination pattern 230. FIG. 10B shows a combined illumination pattern 234 that includes both the low beam illumination pattern 230 and the high beam illumination pattern 236. The combined illumination pattern 234 can be formed when the low beam illumination pattern 230 is projected and the high beam illumination pattern 236 is projected (e.g., both light sources 122, 126 are on). As shown, a portion of the high beam illumination pattern 236 can be overlaid on the low beam illumination pattern 230, near a central region (e.g., vertically and horizontally relative to the view of the graph of FIG. 10B), which creates a region of the combined illumination pattern 234 having a greater lumens value as compared to either the high beam illumination pattern 236 or the low beam illumination pattern 230 alone.

In some non-limiting examples, the high beam illumination pattern 236 and the low beam illumination pattern 230, or both (e.g., the combined illumination pattern 234) can be easily and quickly selected or cycled. For example, because activation of the light source 122 generates the low beam illumination pattern 230, and the activation of the light source 126 generates the high beam illumination pattern 236, activation or deactivation of the light sources 122, 126 can quickly adjust the desired illumination pattern, without the need for any moving components.

The selective activation, and illumination intensity of the lights of the lamp 100, along with the optical rings 110, 166 can provide different illumination schemes, including, for example, a daytime running illumination pattern, and a direction indication illumination pattern (e.g., using the amber light sources).

Figure 11:
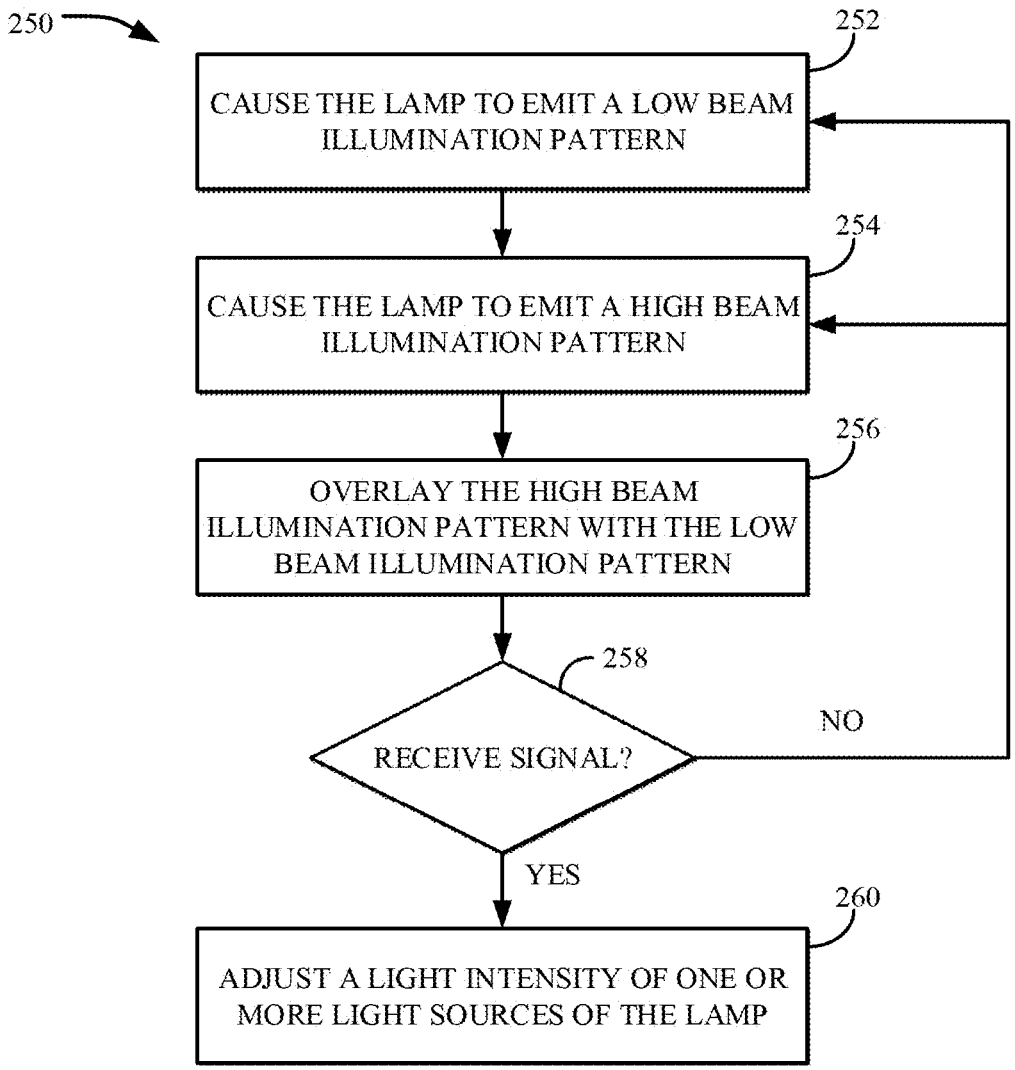
FIG. 11 is a flowchart of a process for illuminating a scene away from a vehicle using a lamp.

FIG. 11 shows a flowchart of a process 250 for illuminating a scene away from a vehicle using a lamp (e.g., the bi-functional lamp 100). In addition, the process 250 can be implemented using one or more computing devices, as appropriate. The computing device (e.g., a controller device) can be in communication with the bi-functional lamp, including each light source of the bi-functional lamp. For example, the computing device can be the computing device of the vehicle, in which the lamp is coupled to the vehicle.

At 252, the process 250 can include a computing device (e.g., in communication with the lamp) causing the lamp to emit a low beam illumination pattern. In some non-limiting examples, this can include causing a first light source (e.g., the light source 122) to emit light towards a reflector of the lamp, and towards an axial symmetric lens of the lamp (e.g., after reflecting off the reflector). In some cases, when the lamp emits the low beam illumination pattern, the lamp does not also emit a high beam illumination pattern. For example, in this case, a computing device can cause a second light source (e.g., the light source 122), different from the first light source, to not (or to stop) emitting light. In some non-limiting examples, causing the lamp to emit the low beam illumination pattern does not involve moving a physical shield that obstructs the projection of light out from the lamp.

At 254, the process 250 can include a computing device causing the lamp to emit a high beam illumination pattern. In some non-limiting examples, this can include causing the second light source to emit light towards an image shifting lens of the lamp and towards the axial symmetric lens of the lamp (e.g., after passing through the image shifting lens). In some non-limiting examples, causing the lamp to emit the high beam illumination pattern does not involve moving a physical shield that obstructs the projection of light out from the lamp.

At 256, the process 250 can include overlaying the high beam illumination pattern with the low beam illumination pattern. In some cases, this can include overlapping a portion of the low beam illumination pattern with a portion of the high beam illumination pattern. In some cases, this can be a related to the position of the light source and corresponding image shifting lens within the lamp (e.g., a bi-functional lamp).

At 258, the process 250 can include a computing device receiving a signal from a vehicle that includes the lamp, a sensor in communication with the computing device, etc. In some cases, the signal can be a user input from a vehicle indicative of activation (or deactivation) of a parking brake, a user input indicative of activation or deactivation (e.g., including the turn direction) of a turn signal user input device (e.g., the turn lever of a vehicle), a user input indicative of activation (or deactivation) of a daytime running lights, a user input indicative of activation (or deactivation) of a low beam, a high beam, or both, etc. In some cases, the signal can be received from a sensor in communication with the computing device. For example, the sensor can be a light sensor (e.g., a photoresistor, a phototransistor, etc.), and the signal can be a light sensor value.

If at the block 258 a computing device does not receive a signal, the process 250 can proceed back to the block 254 to, for example, continue emitting the low beam illumination pattern, the high beam illumination pattern, or both. If, however, at the block 258 a computing device does receive a signal, the process 250 can proceed to the block 260.

At the block 260, the process 260 can include a computing device causing the lamp to adjust a light intensity of one or more light sources of the lamp, which can be based on the received signal from the block 258. For example, if at the block 258 a computing device received from a vehicle a signal indicative of an activation (or deactivation) of a parking break, the computing device can cause one or more light sources of the lamp to emit (or stop emitting, in the case of the deactivation signal) a parking light illumination pattern. In some cases, this can include causing one or more light sources (e.g., the light sources 194, 220) that surround one or more light sources of the lamp (e.g., the light sources 122, 126) to begin emitting light. As another example, if at the block 258, a computing device receives from a vehicle a turn signal indicative of activation (or deactivation) of a turn signal user input device, the computing device can cause one or more light sources of the lamp to emit (or stop emitting, in the case of a deactivation signal) a directional indication illumination pattern. In some cases, this can include causing one or more light sources (e.g., the light sources 194) to emit amber light at a blinking frequency (or in other words a flashing frequency). In some cases, if the lamp is positioned on the same side of the vehicle as the direction indicated by the turn signal (e.g., the right side lamp, and a right turn), then the computing device can cause the one or more lights to blink at a frequency. If, however, the lamp is positioned on an opposing side of the direction indicated by the turn signal, then the computing device can cause the one or more light sources of the lamp not to emit light. In some cases, while the one or more light sources are flashing at a particular frequency, the lamp emits the high beam illumination pattern, the low beam illumination pattern, or both.

As yet another example, if at the block 258, a computing device receives a user input indicative of activation (or deactivation) of daytime running lights, the computing device can cause one or more light sources of the lamp to emit a daytime illumination pattern. In some cases, this can include causing one or more of the light sources 194, 220 to emit light to generate the daytime illumination pattern. As still another example, if at the block 258, a computing device receives a user input indicative of activation (or deactivation) of a low beam, a high beam, or both, the computing device can cause the one or more light sources of the lamp to emit (or stop emitting in the case of deactivation) the low beam illumination pattern, the high beam illumination pattern, or both, depending on the user input. As still yet another example, if at the block 258 a computing device receives a sensor value from a sensor that exceeds (e.g., is less than) a threshold, the computing device can cause one or more light sources of the lamp to emit light (or stop emitting light). For example, the sensor can be a light sensor, and the sensor value can be a light sensor value. In this case, the light sensor value can be compared to a threshold light sensor value, and if the light sensor value exceeds (e.g., is less than) the threshold, the computing device can cause the lamp to emit a high beam illumination pattern, a low beam illumination pattern, or both. If however, the light sensor value is less than a threshold value, the computing device can cause the lamp to stop emitting the high beam illumination pattern, the low beam illumination pattern, or both.

As another example, if at the block 258, a computing device receives a user input indicative of increasing (or decreasing) the illumination intensity of the high beam illumination pattern, the low beam illumination pattern, or both, then the computing device can cause the one or more light sources of the lamp to increase (or decrease) the power (e.g., current) provided to each of the light sources that generate the low beam illumination pattern, the high beam illumination pattern. As a more specific example, if a computing device receives a user input indicative of increasing a high beam illumination pattern, the computing device can cause the light source 126 to increase the light intensity of the light emitted by the light source 126 (e.g., by driving more power to the light source 126). As another more specific example, if a computing device receives a user input indicative of decreasing a low beam illumination pattern, the computing device can cause the light source 122 to decrease the light intensity of the light emitted by the light source 122 (e.g., by driving less power to the light source 122).

Although some of the discussion above is framed in particular around systems, such as the bi-functional lamp 100 those of skill in the art will recognize therein an inherent disclosure of corresponding methods of use (and of making) of the disclosed systems. Correspondingly, some non-limiting examples of the disclosure can include methods of using a bi-functional lamp, and methods of forming (or making) a bi-functional lamp.

Although the invention has been described and illustrated in the foregoing illustrative non-limiting examples, it is understood that the present disclosure has been made only by way of example, and that numerous changes in the details of implementation of the invention can be made without departing from the spirit and scope of the invention, which is limited only by the claims that follow. Features of the disclosed non-limiting examples can be combined and rearranged in various ways.

The present disclosure has described one or more preferred non-limiting examples, and it should be appreciated that many equivalents, alternatives, variations, and modifications, aside from those expressly stated, are possible and within the scope of the invention.

It is to be understood that the disclosure is not limited in its application to the details of construction and the arrangement of components set forth in the following description or illustrated in the following drawings. The disclosure is capable of other non-limiting examples and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

As used herein, unless otherwise limited or defined, discussion of particular directions is provided by example only, with regard to particular non-limiting examples or relevant illustrations. For example, discussion of "top," "front," or "back" features is generally intended as a description only of the orientation of such features relative to a reference frame of a particular example or illustration. Correspondingly, for example, a "top" feature may sometimes be disposed below a "bottom" feature (and so on), in some arrangements or non-limiting examples. Further, references to particular rotational or other movements (e.g., counterclockwise rotation) is generally intended as a description only of movement relative a reference frame of a particular example of illustration.

In some non-limiting examples, aspects of the disclosure, including computerized implementations of methods according to the disclosure, can be implemented as a system, method, apparatus, or article of manufacture using standard programming or engineering techniques to produce software, firmware, hardware, or any combination thereof to control a processor device (e.g., a serial or parallel general purpose or specialized processor chip, a single- or multi-core chip, a microprocessor, a field programmable gate array, any variety of combinations of a control unit, arithmetic logic unit, and processor register, and so on), a computer (e.g., a processor device operatively coupled to a memory), or another electronically operated controller to implement aspects detailed herein. Accordingly, for example, non-limiting examples of the disclosure can be implemented as a set of instructions, tangibly embodied on a non-transitory computer-readable media, such that a processor device can implement the instructions based upon reading the instructions from the computer-readable media. Some non-limiting examples of the disclosure can include (or utilize) a control device such as an automation device, a special purpose or general purpose computer including various computer hardware, software, firmware, and so on, consistent with the discussion below. As specific examples, a control device can include a processor, a microcontroller, a field-programmable gate array, a programmable logic controller, logic gates etc., and other typical components that are known in the art for implementation of appropriate functionality (e.g., memory, communication systems, power sources, user interfaces and other inputs, etc.).

As used herein, unless otherwise defined or limited, ordinal numbers are used herein for convenience of reference based generally on the order in which particular components are presented for the relevant part of the disclosure. In this regard, for example, designations such as "first," "second," etc., generally indicate only the order in which the relevant component is introduced for discussion and generally do not indicate or require a particular spatial arrangement, functional or structural primacy or order.

As used herein, unless otherwise defined or limited, directional terms are used for convenience of reference for discussion of particular figures or examples. For example, references to downward (or other) directions or top (or other) positions may be used to discuss aspects of a particular example or figure, but do not necessarily require similar orientation or geometry in all installations or configurations.

This discussion is presented to enable a person skilled in the art to make and use non-limiting examples of the disclosure. Various modifications to the illustrated examples will be readily apparent to those skilled in the art, and the generic principles herein can be applied to other examples and applications without departing from the principles disclosed herein. Thus, non-limiting examples of the disclosure are not intended to be limited to non-limiting examples shown, but are to be accorded the widest scope consistent with the principles and features disclosed herein and the claims below. The following detailed description is to be read with reference to the figures, in which like elements in different figures have like reference numerals. The figures, which are not necessarily to scale, depict selected examples and are not intended to limit the scope of the disclosure. Skilled artisans will recognize the examples provided herein have many useful alternatives and fall within the scope of the disclosure.

Various features and advantages of the disclosure are set forth in the following claims.

The invention claimed is:

1. A lamp for a vehicle comprising:

a housing;

an axial symmetric lens coupled to the housing and defining an optical axis and a focal point;

a first light source positioned within the housing, the first light source being positioned behind the focal point of the axial symmetric lens relative to the optical axis;

a second light source positioned within the housing, the second light source being positioned in front of the focal point of the axial symmetric lens relative to the optical axis; and an image shifting lens positioned within the housing between the second light source and the axial symmetric lens, the first light source is configured to emit first light along a first optical path that extends from the first light source, toward the axial symmetric lens below the optical axis, and through the axial symmetric lens to define a low beam illumination pattern, the second light source is configured to emit second light along a second optical path that extends, from the second light source, through the image shifting lens, towards the axial symmetric lens above the optical axis, and through the axial symmetric lens to define a high beam illumination pattern.

2. The lamp of claim 1, wherein at least a portion of the image shifting lens is positioned above the focal point and above the optical axis of the axial symmetric lens, and wherein the image shifting lens is configured to receive at a rear surface an image defining a first focal point, and to project a shifted image out of a front surface of the image shifting lens, the shifted image defining a second focal point that is shifted from the first focal point away from the axial symmetric lens relative to the optical axis.

3. The lamp of claim 2, wherein the second focal point of the shifted image overlaps with the focal point of the axial symmetric lens.

4. The lamp of claim 1, further comprising a reflector positioned within the housing, and wherein the first optical path extends from the first light source, towards the reflector, and towards the axial symmetric lens away from the reflector.

5. The lamp of claim 4, further comprising a physical shield positioned within the housing, the physical shield blocking a portion of light emitted from the first light source from being transmitted through the axial symmetric lens.

6. The lamp of claim 5, wherein the physical shield is positioned below an upper reflective surface of the reflector, wherein the physical shield has an extension that extends out from the interior volume of the reflector towards the axial symmetric lens, the extension defines a peripheral edge that includes:

a first linear region;

a second linear region; and a curved region between the first and second linear regions, the curved region being concave.

7. The lamp of claim 5, wherein the physical shield is oriented parallel to the optical axis of the axially symmetric lens, and wherein the physical shield includes a well, and wherein a first thickness of the physical shield at the well is smaller than a second thickness of the physical shield.

8. The lamp of claim 5, wherein a portion of the physical shield overlaps with the focal point of the axial symmetric lens.

9. The lamp of claim 4, further comprising:

a wall coupled to and positioned within the housing, the wall extending towards the optical axis so that the wall is substantially perpendicular to the optical axis; and a support coupled to and positioned within the housing, the support extending away from the axial symmetric lens relative to the optical axis, a portion of the support being substantially parallel to the optical axis, and wherein the first light source is coupled to a surface of the support that faces the reflector, and wherein the second light source is coupled to a surface of the wall that faces the axial symmetric lens.

10. The lamp of claim 4, wherein the first light source is configured to emit light that is reflected by the reflector and transmitted through the axial symmetric projection lens, wherein a portion of the reflected light is blocked and prevented from being transmitted to the axial symmetric projection lens by the physical shield, and wherein the reflected light defines a low beam illumination pattern.

11. The lamp of claim 4, wherein the second light source is configured to emit light that defines an image through the image shifting lens, the image shifting lens being configured to shift the image back to the focal point of the axial symmetric projection lens, and wherein the image when projected through the axial symmetric lens defines a high beam illumination pattern.

12. The lamp of claim 1, wherein a portion of the high beam illumination pattern is overlaid on the low beam illumination pattern so that the portion of the high beam illumination pattern overlaps with the low beam illumination pattern.

13. A lamp for a vehicle comprising:

a housing;

an axial symmetric lens coupled to the housing and defining an optical axis and a focal point;

an image shifting lens positioned within the housing behind the axial symmetric lens relative to the optical axis;

a light source positioned within the housing, the light source being positioned behind the image shifting lens, the light source being configured to emit light along an optical path that extends, from the light source, through the image shifting lens, towards the axial symmetric lens above the optical axis, and through the axial symmetric lens to define a high beam illumination pattern, and wherein the light source is configured to emit light that defines an image through the image shifting lens, the image shifting lens being configured to shift the image back to the focal point of the axial symmetric projection lens, and wherein the image when projected through the axial symmetric lens defines a high beam illumination pattern.

14. The lamp of claim 13, wherein the light source is a first light source, the optical path is a first optical path, and further comprising:

a reflector positioned within the housing;

a second light source positioned within the housing, the second light source being positioned behind the focal point of the axial symmetric lens relative to the optical axis; and a physical shield that has a peripheral edge that overlaps with the focal point of the axial symmetric lens, and wherein the second light source is configured to emit second light along a second optical path that extends from the second light source, towards the reflector, towards the axial symmetric lens away from the reflector, and through the axial symmetric lens to define a low beam illumination pattern.

15. The lamp of claim 14, further comprising a first plurality of light sources positioned within the housing in front of the second light source and surrounding the first light source, the plurality of light sources emitting light having a different color than the light emitted from the first light source and the second light source.

16. The lamp of claim 14, further comprising a wall positioned within the housing between the reflector and the image shifting lens, and wherein the first light source is coupled to the wall.

17. The lamp of claim 14, wherein the focal point of the axial symmetric lens is positioned between the first light source and the second light source.

18. A bi-functional lamp for a vehicle, the lamp comprising:

a housing having a first end and a second end;

an axial symmetric lens coupled to the housing and defining an optical axis and a focal point;

a reflector arranged within the housing and positioned adjacent to the second end of the housing;

a physical shield arranged within the housing;

an image shifting lens arranged within the housing between the axial symmetric lens and the physical shield along the optical axis, the image shifting lens being configured to shift an image emitted onto a rear surface of the image shifting lens back to substantially the focal point of the axial symmetric lens to define a shifted image, which is projected out of the front surface of the image shifting lens;

a first light source arranged to emit first light toward the reflector, which is reflected by the reflector and transmitted through the axial symmetric lens, wherein a portion of the first light reflected from the reflector is blocked and prevented from being transmitted to the axial symmetric lens by the physical shield, and wherein the first light transmitted through the axial symmetric lens defines a low beam illumination pattern; and a second light source arranged axially between the physical shield and the image shifting lens and arranged to emit light through the image shifting lens, the second light source being configured to emit light through the image shifting lens, which defines a high beam illumination pattern, and a portion of the high beam illumination pattern is overlaid on the low beam illumination pattern.

19. The bi-functional lamp of claim 18, further comprising:

an optical ring having a hole directed therethrough, the optical ring surrounding the first light source and the second light source, and the optical ring being positioned between the axial symmetric lens and the first light source;

a first plurality of light sources being positioned within the housing and surrounding the second light source, wherein the first plurality of light sources emit light having a different color than the light emitted from the first light source and the second light source, and wherein the first plurality of light sources are configured to emit amber light, and wherein the first light source and the second light source are configured to emit white light.

* * * * *